US005556469A

United States Patent [19]

Koyama et al.

[11] Patent Number: 5,556,469

[45] **Date of Patent: * Sep. 17, 1996**

[54] COATING FILM TRANSFER TOOL

[75] Inventors: Kouhei Koyama, Osaka; Shigeru Tamai, Ikeda; Masatoshi Shintani, Sanda, all of Japan

[73] Assignee: Seed Rubber Company Limited, Osaka, Japan

[ * ] Notice: The term of this patent shall not extend beyond the expiration date of Pat. No. 5,490,898.

[21] Appl. No.: 346,241

[22] Filed: Nov. 23, 1994

[30] Foreign Application Priority Data

Dec. 3, 1993 [JP] Japan ..... 5-339247

[51] Int. Cl.[6] ..... B05C 17/00

[52] U.S. Cl. ..... 118/257; 156/577; 156/579

[58] Field of Search ..... 118/106, 200, 118/257; 156/577, 579; 400/695, 696, 700

[56] References Cited

U.S. PATENT DOCUMENTS

| | | | |
|---|---|---|---|
| 4,426,169 | 1/1984 | Hartmann | 400/696 |
| 4,521,471 | 6/1985 | Merrill | 400/696 |
| 4,547,088 | 10/1985 | Shattuck | 400/696 |
| 4,671,687 | 6/1987 | Tamai | 400/695 |
| 4,718,971 | 1/1988 | Summers | 156/579 |
| 4,826,562 | 5/1989 | Ehlis | 156/577 |
| 5,125,589 | 6/1992 | Manusch | 156/577 |
| 5,310,445 | 5/1994 | Tucker | 156/577 |
| 5,346,580 | 9/1994 | Elges et al. | 156/577 |
| 5,379,477 | 1/1995 | Tamai et al. | 118/257 |

FOREIGN PATENT DOCUMENTS

| | | | |
|---|---|---|---|
| 5-13800 | 2/1993 | Japan . | |
| 5-58097 | 3/1995 | Japan . | |
| 2157233 | 10/1985 | United Kingdom | 400/696 |

*Primary Examiner*—Laura Edwards

*Attorney, Agent, or Firm*—Nikaido, Marmelstein, Murray & Oram LLP

[57] ABSTRACT

A coating film transfer tool having such a construction as to allow the user to use with a writing tool-like feeling, whether in vertical pulling or in lateral pulling, depending on the user's manner of holding a writing tool. A coating film transfer head is adjustable in angle about its axial line, and by adjusting the head angle according to the application of the user or depending on the user's manner of holding a writing tool, the user can grip the case like holding a writing tool, and press a coating film transfer tape tightly onto the sheet surface or the like by the front end pressing part of the head.

18 Claims, 19 Drawing Sheets

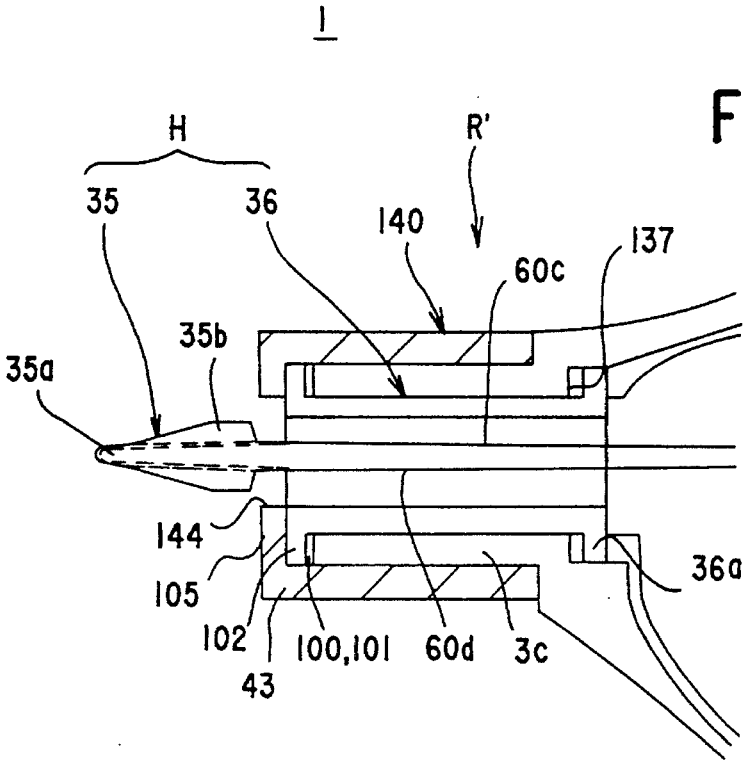
FIG.15
FIG.16
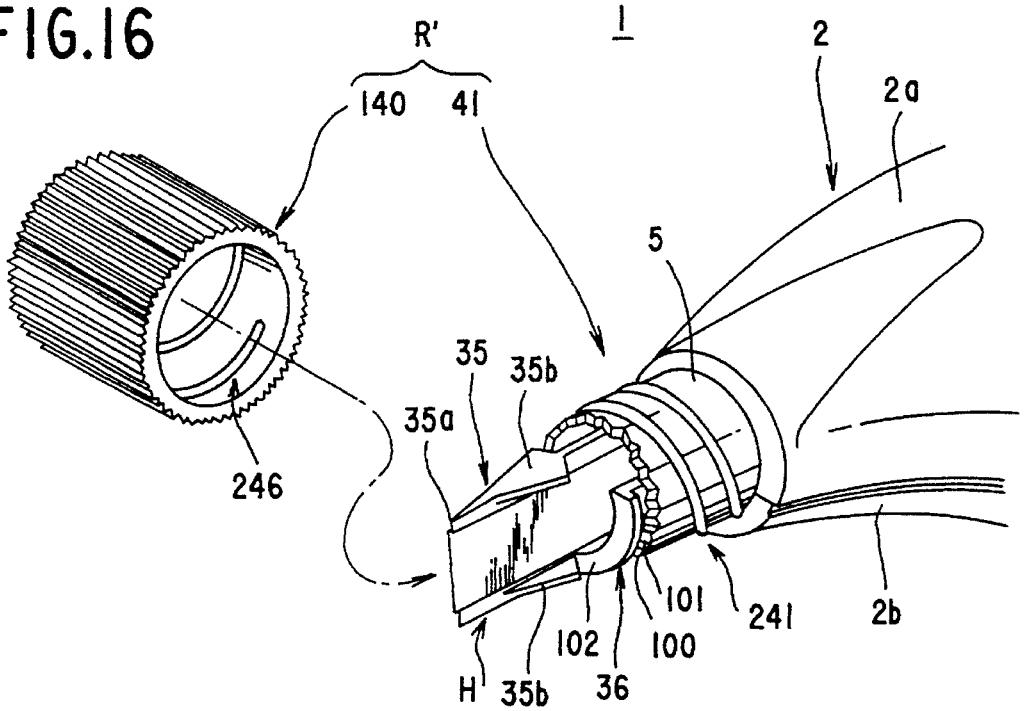

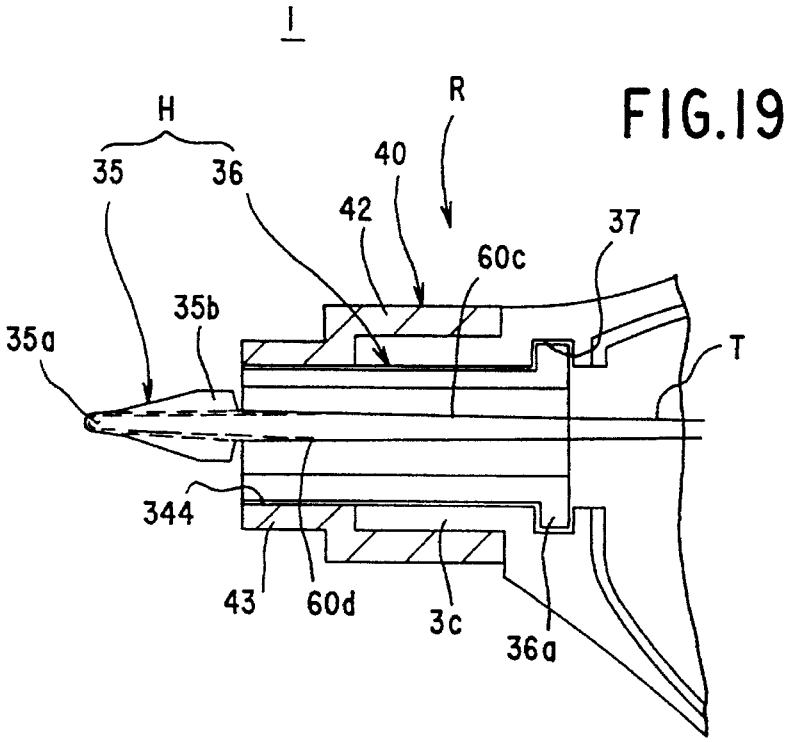
FIG.19
FIG.20
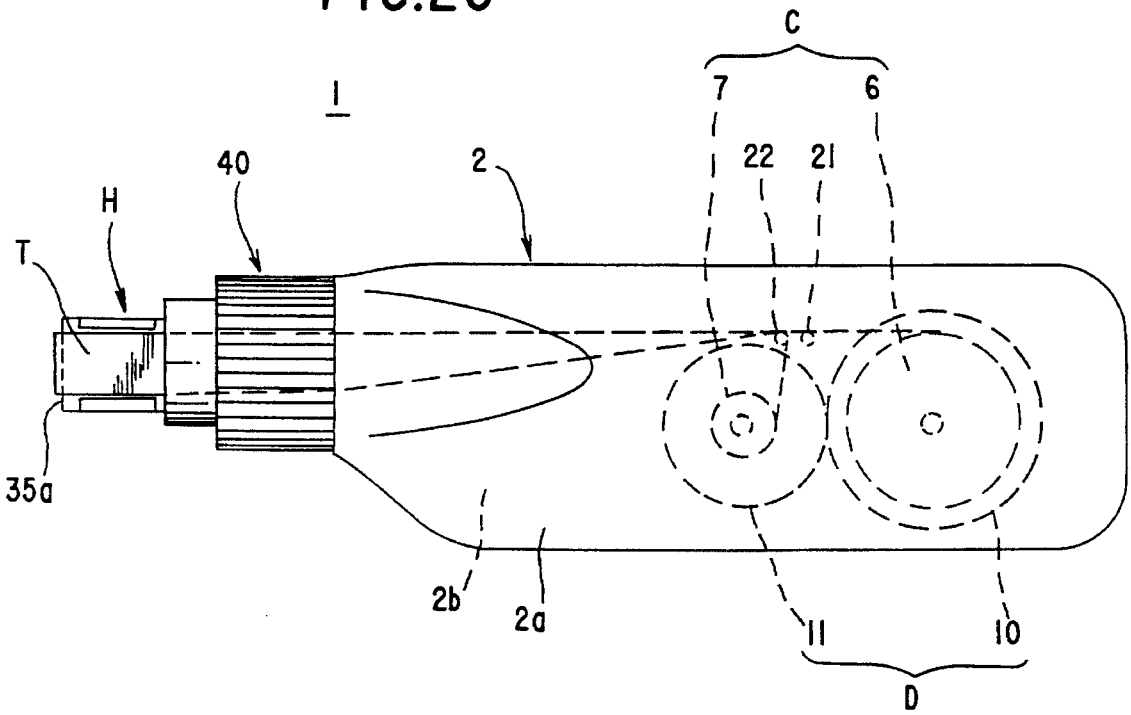

COATING FILM TRANSFER TOOL

BACKGROUND OF THE INVENTION

1. Field of the Invention

The present invention relates to a coating film transfer tool for transferring a coating film such as a corrective paint layer and an adhesive layer on a coating film transfer tape onto a paper surface or the like, and more particularly to a coating film transfer tool allowing the individual users to take a position of use freely depending on the own manner of holding the pencil or other writing implement in the transfer operation of the coating film.

2. Description of the Related Art

As examples of this kind of coating film transfer tool, we proposed coating film transfer tools disclosed in Japanese Laid-open Patent No. 5-58097 and Japanese Laid-open Utility Model No. 5-13800.

These coating film transfer tools are mainly used as erasing tools for correcting errors or the like, and comprise, as shown respectively in FIG. 23 and FIG. 24, a pay-out reel (c) with a coating film transfer tape (b) wound thereabout, and a winding reel (d) for collecting the coating film transfer tape (b) after use, rotatably provided in a case (a) that is held and manipulated by hand. The case (a) has a coating film transfer head (f) for pressing the coating film transfer tape (b) against a transfer area (correction area on paper) (e), projecting from a front end thereof. The coating film transfer tape (b) paid out of the pay-out reel (c) is wound on the winding reel (d) through a pressing part (g) in the front end of the head (f).

Herein, the case (a) is formed in a flat box-like shape, having contour shape and size and width size sufficient for containing the pay-out reel (c) and winding reel (d) therein, and the flat front and back surfaces of the case (a), that is, the front and back surfaces relative to the sheet surface of FIG. 23 and FIG. 24 are gripping surfaces to be held by hand when manipulating.

In the former example, as shown in FIG. 23, it is constituted so that the pressing part (g) of the head (f) may guide the coating film transfer tape (b) in a same attitude as it is wound about the pay-out reel (c) and winding reel (d), and it is a so-called vertical pulling applicable structure suited to correction of part of vertically written sentence such as a Japanese text. That is, when using, the user grips the gripping surfaces (front and back surfaces) of the case (a) by fingers, and presses the coating film transfer tape (b) tightly to the correction area (e) by the pressing part (g) of the head (f) as shown in the drawing, and moves the case (a) in the vertical direction, that is, in the downward direction (arrow direction in FIG. 23) relative to the sheet surface or the like. As a result, the corrective paint layer of the coating film transfer tape (b) in the pressing part (g) of the head (f) is applied onto the correction area (e) and the character or the like is covered and erased, while the coating film transfer tape (b) after use is collected on the winding reel (d).

In the latter example, on the other hand, as shown in FIG. 24, it is constituted so that the pressing part (g) of the head (f) may guide the coating film transfer tape (b) to be nearly opposite to the gripping surfaces of the case (a), and it is a so-called lateral pulling applicable structure suited to correction of part of laterally written sentence such as an alphabetic text. That is, when using, the user grips the gripping surfaces of the case (a) by fingers, presses the coating film transfer tape (b) tightly onto the correction area (e) by the pressing part (g) of the head (f), and moves the case (a) in the sideways direction, that is, in the lateral direction relative to the sheet surface or the like (the vertical direction relative to the sheet surface of FIG. 24), thereby erasing the character or the like in the same manner as above.

In either constitution, however, it is possible to use with a writing tool-like feeling in either vertical pulling use or lateral pulling use, but a very irrational position was required in the other use.

Moreover, each user has his or her own manner of holding a writing tool, and the structure assuming an ideal and identical writing tool position as mentioned above could not realize the use with a writing tool-like feeling in all users.

BRIEF SUMMARY OF THE INVENTION

It is hence a primary object of the invention to provide a novel coating film transfer tool eliminating the conventional problems.

It is another object of the invention to provide a coating film transfer tool allowing individual users to take a position of use freely depending on the manner of holding a pencil or other writing tool, and being usable with a writing tool-like feeling whether in vertical pulling or in lateral pulling.

It is a different object of the invention to provide a coating film transfer tool in which a coating film transfer head rotates freely about its axis, following in the direction of action of force, and its angle in the rotating direction is properly adjusted, so that a coating film transfer tape is always kept in tight contact on a transfer area by a pressing part of the head.

It is another different object of the invention to provide a coating film transfer tool capable of transferring a coating film transfer tape whether in linear form or in curved form, or in a continuous form of both.

In a constitution of the coating film transfer tool of the invention, a pay-out reel with a coating film transfer tape wound thereabout, and a winding reel for collecting the coating film transfer tape after use are rotatably provided in a case that can be held and manipulated by hand, a coating film transfer head for pressing the coating film transfer tape on a transfer area is projected from the front end of the case, and the coating film transfer tape paid out from the pay-out reel is wound on the winding reel through the front end pressing part of the head, while the head is adjustable in angle about its axial line. Preferably, the head has its pressing part adjustable in angle in plural steps, between the angle for guiding the coating film transfer tape in a same attitude as it is wound about the pay-out reel and winding reel, and the angle for guiding the coating film transfer tape nearly opposite to the gripping surfaces of the case, or the head is rotatable freely.

When using the coating film transfer tool of the invention as an erasing tool for correcting a wrong letter or the like, the pressing part of the head is fitted to a starting end of a transfer area to be corrected of error, and the case is moved in this state along the transfer area, and is stopped at a terminal end of the transfer area. As a result, a corrective paint layer of the coating film transfer tape in the pressing part of the head is peeled off a base film and is transferred on the transfer area, and the error is covered and erased, while the base tape on which only a peeling agent layer is left over after use is collected on the winding reel either automatically or manually.

In this case, since the head is adjustable in angle about its axial line, the user can adjust the head angle, depending on the application and the own manner of holding a writing tool, and can press the coating film transfer tape tightly on the sheet surface or the like by the pressing part of the head, by gripping the case itself with a writing tool-like feeling, so that it is very easy to use.

Moreover, when the head is structured so as to be freely rotatable about its axial line, the head rotates freely following the direction of force of action, and its angle is properly adjusted, and therefore the coating film transfer tape is always pressed tightly on the transfer area by the pressing part of the head, and is transferred whether in linear form or in curved form, or in a continuous form of both.

Herein, that the coating film transfer tape is "nearly opposite to the griping surfaces of the case" means that the front and back sides of the coating film transfer tape nearly confront the gripping surfaces of the case, or in other words the front and back sides of the coating film transfer tape are directed nearly in the same direction as the gripping surfaces of the case, and it is meant the same throughout the specification.

The above and other objects and features relating to the invention will be better understood by reading the detailed description taken in conjunction with the accompanying drawings and novel facts disclosed in the claims.

BRIEF DESCRIPTION OF THE DRAWINGS

FIG. 15 is a magnified side view showing the constitution of the rotative part in a partial section.

FIG. 16 is an exploded perspective view showing the constitution of a rotative part of an erasing tool according to embodiment 3 of the invention in a cap member detached state.

FIG. 19 is a magnified side view showing the constitution of the rotative part in a partial section.

FIG. 20 is a front view of an erasing tool according to embodiment 6 of the invention.

DETAILED DESCRIPTION OF THE PREFERRED EMBODIMENTS

Figure 1:
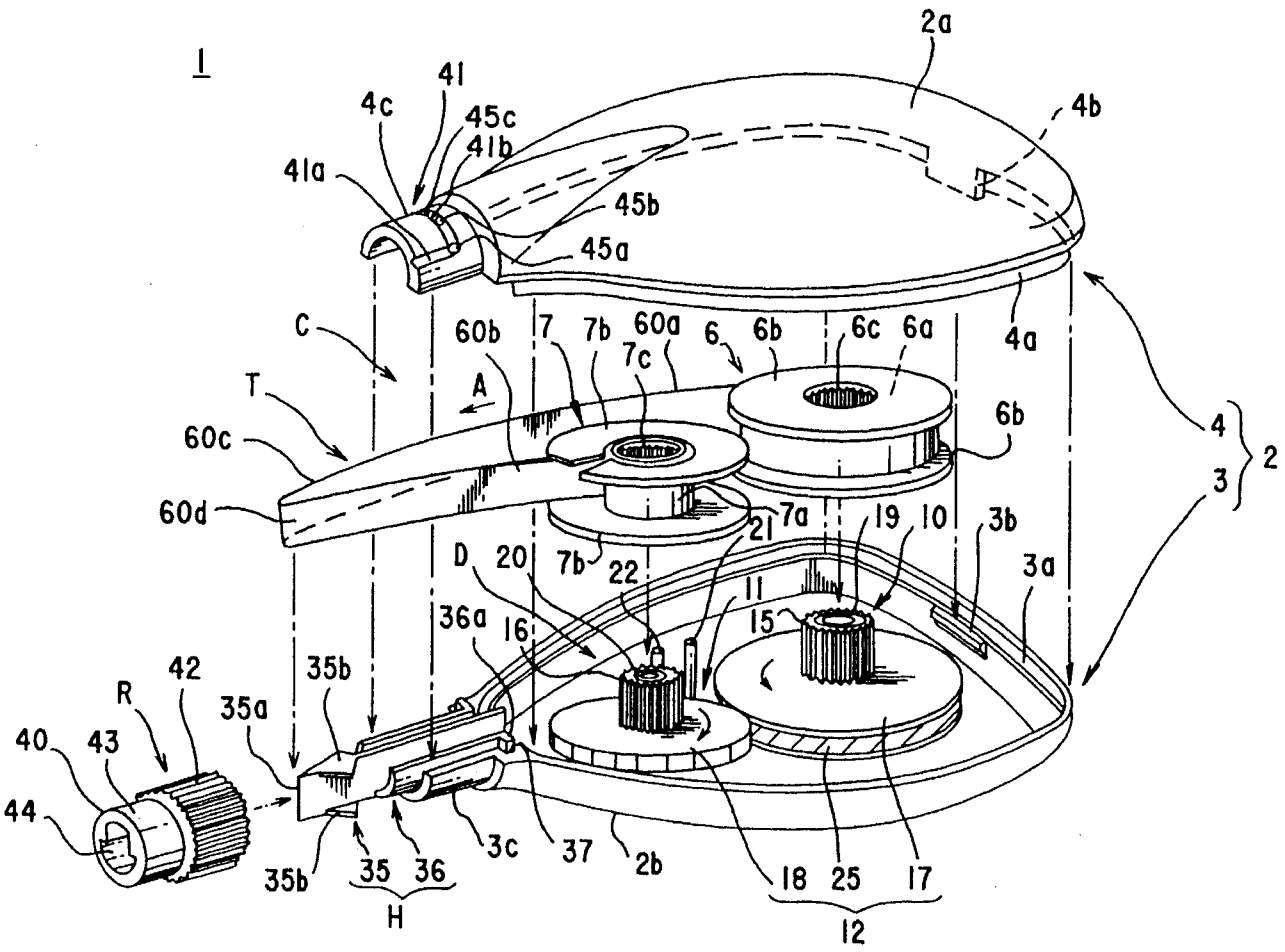
FIG. 1 is an exploded perspective view of an erasing tool according to embodiment 1 of the invention.

Embodiments of the invention are described below by referring to the drawings.

FIG. 1 through FIG. 22 show coating film transfer tools according to the invention, in which same reference numerals refer to identical constituent components or elements.

Embodiment 1

A coating film transfer tool according to the invention is shown in FIG. 1 through FIG. 5, and this coating film transfer tool 1 is specifically used as an erasing tool for correcting a wrong letter or the like, and a coating film transfer tape T as a consumable piece is provided in an exchangeable cartridge type or refill type.

In the coating film transfer tool 1, as shown in FIG. 1, a tape cartridge C, a tape drive unit D, a coating film transfer head H, and a rotative part R are provided in a hand-held case 2. In this erasing tool 1, the head H is adjustable in angle about its axial center, between a vertical pulling operation basic position (also coating film transfer tape exchange position) X shown in FIG. 2, and a lateral pulling operation basic position Y. The individual constituent components are described below.

I. Case 2:

The case 2 is, as shown in the drawings, a flat box having a front contour shape and dimensions and width capable of accommodating the tape cartridge C and tape drive unit D. As described later, flat front and back surfaces 2*a*, 2*b* of this case 2 are gripping surfaces when holding and operating by hand.

This case 2 is a plastic piece formed by injection forming or the like, and has a divided structure comprising a case main body 3 and a cap body 4. For this purpose, a mating recess 3*a* is formed in an opening of the case main body 3 almost entirely along an inner circumference thereof, and an engaging portion 3*b* is provided in a rear end thereof. A mating rib 4*a* of the cap body 4 is fitted into the mating recess 3*a*, and a stopper claw 4*b* of the cap body 4 engages with the engaging portion 3*b*. At front ends of the case main body 3 and cap body 4, semicylindrical portions 3*c*, 4*c* are provided respectively, and these semicylindrical portions 3*c*, 4*c* are integrated by a cap member 40, which will be described later.

Thus, in assembling the case 2, firstly, the stopper claw 4*b* of the cap body 4 is engaged with the engaging portion 3*b* of the case main body 3, and then the semicylindrical portions 3*c*, 4*c* are combined with each other, while the mating rib 4*a* is fitted into the mating recess 3*a*. Finally, the cap member 40 is fitted into the integrated part (cylindrical front end) 5.

II. Tape cartridge C:

The tape cartridge C comprises a set of a pay-out reel 6 with the coating film transfer tape T wound thereabout, and a winding reel 7 for collecting the used coating film transfer tape T'. The tape cartridge C is detachably attached to a tape drive unit D of the case main body 3. Before attachment, not shown, the tape cartridge C is held by a fixing member for fixing the reels 6, 7.

The coating film transfer tape T is structured, for example, as follows. That is, although specific structure is not shown, the coating film transfer tape T has a release agent layer such as vinyl chloride-vinyl acetate copolymer resin and low molecular polyethylene formed on one side of a film base (about 25 to 38 μm) of plastics such as polyester film and acetate film, or paper, and a white corrective paint layer is formed on this release agent layer, and further on this corrective paint film layer is formed an adhesive (pressure sensitive adhesive) layer such as pressure adhesive polyurethane. As the corrective paint layer, a so-called dry type paint is employed that allows writing in a corrected area immediately after transfer.

The pay-out reel 6 and winding reel 7 respectively comprise drum parts 6*a*, 7*a* for winding the coating film transfer tape T on. Tape guide flanges 6*b*, 7*b* are provided at both sides of the drums 6*a*, 7*a*, and mounting holes 6*c*, , 7*c* having toothed engagement part such as serration and spline are provided in the diametric center of the drums 6*a*, 7*a*.

III. Tape drive unit D:

The tape drive unit D is provided in the case main body 3. The tape drive unit D comprises mainly a rotating pay-out part 10 for rotating and driving the pay-out reel 6, a rotating winding part 11 for rotating and driving the winding reel 7, and an interlocking part 12 for interlocking these rotating parts 10, 11.

The rotating pay-out part 10 and rotating winding part 11 comprise respectively hollow rotating shaft parts 15, 16, as shown in FIG. (2), and flat rotating disks 17, 18 formed integrally. The rotating shaft parts 15, 16 are rotatably supported on the outer circumference of hollow support shafts 19, 20 provided upright in an inner side of the case main body 3. At upper ends of these hollow support shafts 19, 20, a stopping part 70 is provided as shown in FIG. 7 (*a*).

Figure 7A:
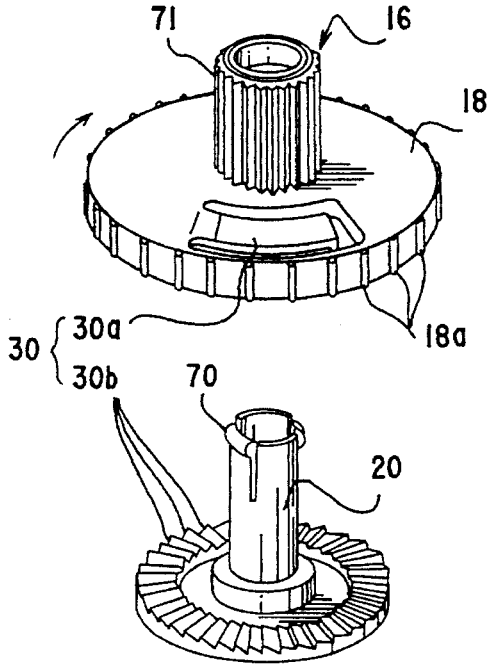
FIG. 7 shows a reverse rotation preventive mechanism of the tape drive unit, FIG. 7 (*a*) is an exploded perspective view of the reverse rotation preventive mechanism, and FIG. 7 (*b*) is a magnified perspective view for explaining the operation of the reverse rotation preventive mechanism.
Figure 7B:
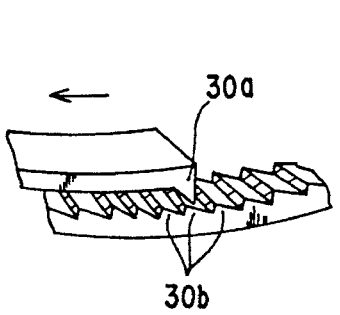

On an outer circumference of the rotating shaft parts 15, 16, as shown in FIG. 7 (*a*), toothed engagement parts 71 such as serration and spline are provided respectively corresponding to the toothed engagement parts of the mounting holes 6*c*, 7*c* of the pay-out reel 6 and winding reel 7. These toothed engagement parts 71, 71 are detachably engaged with the mounting holes 6*c*, 7*c* of the both reels 6, 7 to support, and hence the pay-out reel 6 and winding reel 7 are detachably attached to the rotating shaft parts 15, 16 for integral rotation.

In this case, the rotating disks 17, 18 serve as receptacle support surfaces for the pay-out reel 6 and winding reel 7. In association with them, a pair of guide pins 21, 22 are provided upright at the inner side of the case main body 3 in the vicinity of the mounting position of the both reels 6, 7. These guide pins 21, 22 guide the coating film transfer tape T.

Figure 6:
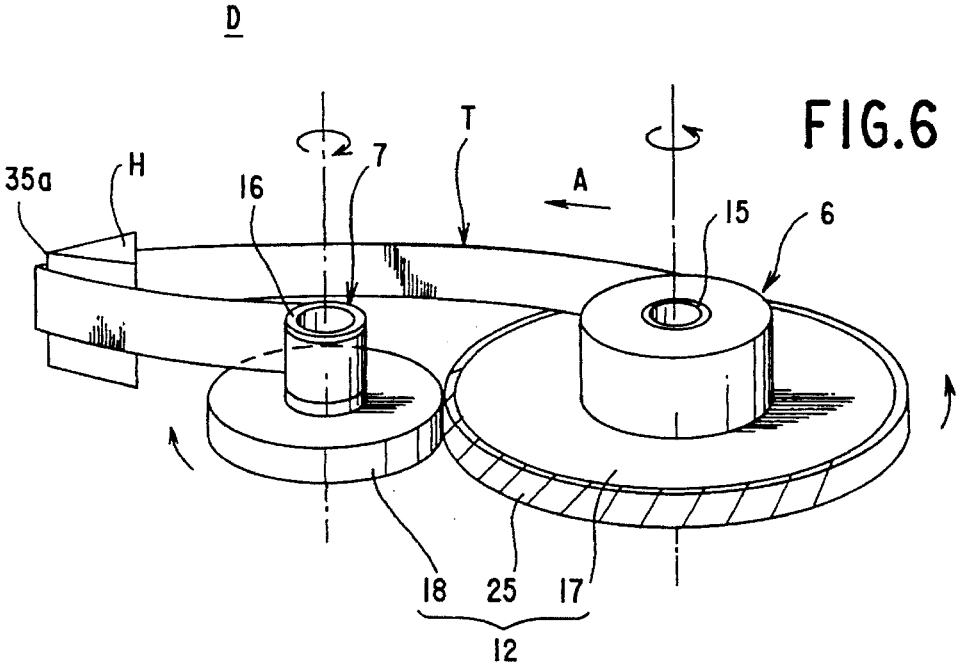
FIG. 6 is a schematic perspective view showing a basic constitution of a tape drive unit of the erasing tool.

The interlocking part 12 is for interlocking the rotating winding part 11 to the rotating pay-out part 10, and comprises the rotating disks 17, 18 and slide means 25, as shown in FIG. 6.

The slide means 25 actually comprises a frictional member such as silicone rubber, for example, O-ring, and serves for transferring rotational movement between the rotating parts 10, 11, and functioning additionally as slide means to synchronize pay-out and winding speeds of the coating film transfer tape T in the pay-out reel 6 and winding reel 7.

The frictional member 25 is attached to an outer circumference of one rotating disk 17, and constructed in such manner that it can frictionally engage with the outer circumference of the other rotating disk 18. For this purpose, anti-slipping ribs 18*a*, 18*a*, . . . as shown in FIG. 7 (*a*) are formed on the outer circumference of rotating disk 18 to increase frictional resistance to the frictional member 25. The anti-slipping rib 18*a* and the frictional member 25 may be arranged in a structural relationship contrary to that of the figure. That is, the frictional member 25 may be attached to the outer circumference of rotating disk 17 that is in the driven side, and the anti-slip rib formed on the outer circumference of rotating disk 17 that is in the driving side (not shown).

The ratio of rotation or ratio of outer diameters between the rotating disks 17, 18 in the driving and driven sides is appropriately set, considering a winding diameter of the coating film transfer tape T in the reels 6, 7, so that the coating film transfer tape T can be smoothly paid out, and wound. In the embodiment shown, the rotating disk 18 in the driven side is set, in diameter, at approximately half of the rotating disk 17 in the driving side.

Accordingly, by pressing action of the coating film transfer head H, as will be described later, when a tensile force (in the direction of arrow A) applied to the coating film transfer tape T acts as a rotational torque to the pay-out reel 6, the pay-out reel 6 and, therefore, the rotating disk 17 of rotating pay-out part 10 that is integrated therewith in the rotating direction are rotated. The torque effects rotation of the rotating disk 18 of rotating winding part 11 in the driven side by means of the frictional force of frictional member 25 and, accordingly, associated rotation of the winding reel 7 that is integrated with the rotating disk 18 in the rotating direction, and the used coating film transfer tape T' is automatically wound about the winding reel 7.

In this case, the ratio of rotation (corresponding to the ratio of outer diameter) between the rotating disks 17 and 18 in the driving and driven sides is constant at any time, while the ratio of outer diameter between the coating film transfer tape T about the pay-out reel 6 and the coating film transfer tape T' about the winding reel 7 shows a time-course change, and is inconstant. In other words, as the tape is used, the outer diameter of the coating film transfer tape T about the pay-out reel 6 is gradually reduced, while that of the coating film transfer tape T' about the winding reel 7 is increased on the contrary.

Therefore, the winding speed of winding reel 7 is increased in comparison with the pay-out speed of pay-out reel 6 as time elapses, and the rotational torque acting to the pay-out reel 6 is gradually increased, because the speeds come to be non-synchronized with each other. Then, as the rotational torque overcomes the frictional force of frictional member 25, and the rotating disk 17 in the driving side slips in rotation relative to the rotating disk 18 in the driven side, the pay-out speed and winding speed are synchronized, and a smooth driving of the coating film transfer tape T is assured.

Incidentally, if the speeds remains in such non-synchronized condition, because the coating film transfer tape T is subjected to an excessive tensile force, such inconveniences may be caused that the tape T is elongated, or broken in the middle in a worst case.

Additionally, as shown in FIG. 7, the rotating winding part 11 is provided with a backstop mechanism 30 for preventing inverse rotation of the reels 6, 7. The backstop mechanism 30 comprises a stopper claw 30*a* placed in the rotating disk 18 and multiple backstop claws 30*b*, 30*b*, . . . provided in the form of a ring concentric with the hollow supporting shaft 20 in an inner surface of the case main body 3. The stopper claw 30*a* is oriented downward in a form of a thin plate elastically changing in shape in the vertical direction to the rotating disk 18. The backstop claws 30*b* have a wedge-like shape in section, as shown in the figure, that is, inclined upward in the direction of normal rotation (shown by an arrow) of the winding reel 7, and falls approximately vertically from its peak.

Therefore, when the reels 6, 7 are turned in the direction of arrow, the stopper claw 30*a* is elastically changed in shape, and rides over the backstop claws 30*b*, 30*b*, . . . to allow the normal rotation. On the contrary, when the reels 6, 7 are turned in the direction opposite to that of the arrow, the stopper claw 30*a* is engaged with one of the backstop claws 30*b*, 30*b*, . . . and prevents the inverse rotation. The backstop mechanism 30 may be employed in the rotating pay-out part 10.

IV. Coating film transfer head H:

The coating film transfer head H is for pressing the coating film transfer tape T against correction area (transfer area) such as an error in a sheet surface, and is attached to an inner circumference of the cylindrical front end 5 of the case 2 to be rotatable about the axis.

The head H is made of a plastic material having some degree of elasticity, and comprises a head body 35 for guiding and pressing the coating film transfer tape T and a bearing part 36 held in the cylindrical front end 5.

The head body 35 is a thin plate slightly wider than the coating film transfer tape T, and is tapered in section such that it is gradually reduced in thickness toward its front end, and its front end 35*a* provides a pressing part for applying pressure to the coating film transfer tape T. In addition, the head body 35 is provided with guide flanges 35*b*, 35*b* in both edges thereof for guiding the coating film transfer tape T. The shape and structure of the head body 35 may be modified depending on the purpose or the like as far as the pressing part 35*a* has the function of guiding and pressing the coating film transfer tape T.

Figure 8:
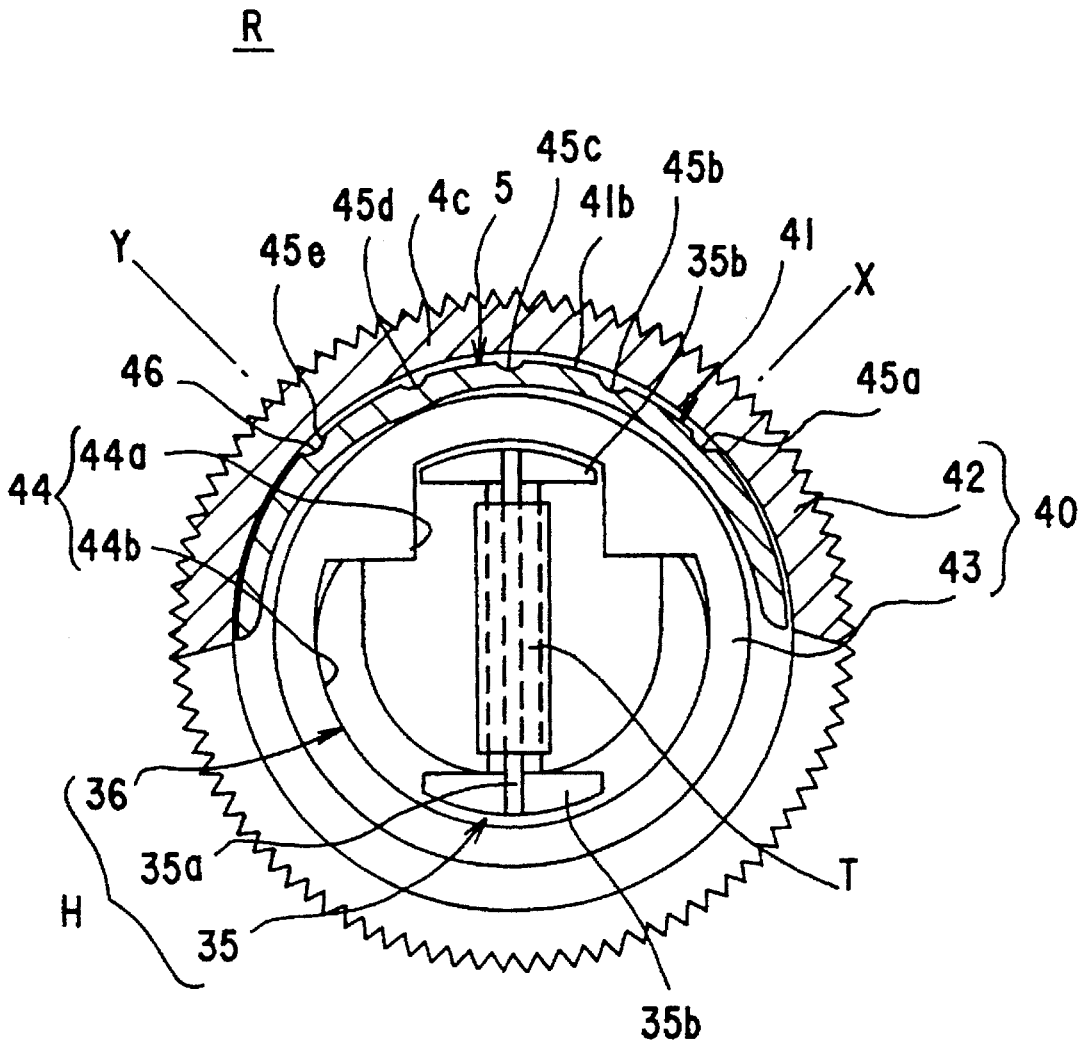
FIG. 8 is a partially cut-away front view of a coating film transfer head and a rotative part of the erasing tool, showing the coating film transfer head in a lateral pulling operation basic position.

The bearing part 36 has an arcuate section open in an upper part thereof to form a semicylindrical shape, as shown in FIG. 8, and an outer diameter set in correspondence with the inner diameter of semicylindrical parts 3*c*, 4*c* of the case 2. Further, an arcuate flange 36*a* is formed in a base end of the bearing part 36 for axial positioning of the head H, and an arcuate engagement groove 37 is formed correspondingly in an inner base circumference of the semicylindrical parts 3*c*, 4*c*, respectively.

In such manner, the bearing part 36 is axially supported rotatably in the inner circumference of semicylindrical parts 3*c*, 4*c*, and the arcuate flange 36*a* rotatably engaged with the arcuate engagement grooves 37, 37, thus, the head H is positioned axially in the cylindrical front end 5 of case 2, and attached rotatably about the axis thereof.

V. Rotative part R:

The rotative part R is provided in the cylindrical front end 5 of case 2 for rotating the head H, and comprises a cap member 40 detachably attached to the cylindrical front end 5 and a positioning part 41 placed on the outer circumference of cylindrical front end 5.

The cap member 40 is an integral molding of plastic material, and comprises a base part 42 fitted over the cylindrical front end 5 and an engagement part 43 integrally engaged with the head H in the rotating direction.

The base part 42 serves as an assembly fixing member for the case 2 and a rotative part as well. The base part 42 has an inner cylindrical diameter set in such manner that it is rotatably fitted over the outer circumference of cylindrical front end 5, and multiple toothed anti-slip ribs are formed on an outer circumference of the base part 42.

The engagement part 43 is provided with a through hole 44 for receiving the head H. The through hole 44, is dimensionally configured such that the cap member 40 and head H are integrally engaged with each other in the rotating direction, when the head H is inserted. In other words, the through hole 44 comprises, as shown in a front view in FIG. 8, an upper part 44*a* dimensionally configured so as to conform to the outer circumference of head body 35 of the head H, and a lower part 44*b* dimensionally configured so as to conform to the outer circumference of bearing 36 of the head H.

The positioning part 41 is for resiliently positioning and fixing the cap member 40 in position in the rotating direction. The positioning part 41 is provided on an outer circumference of the cylindrical front end 5, more particularly, on an outer circumference of the semicylindrical part 4*c* in the cap body 4.

Figure 9A:
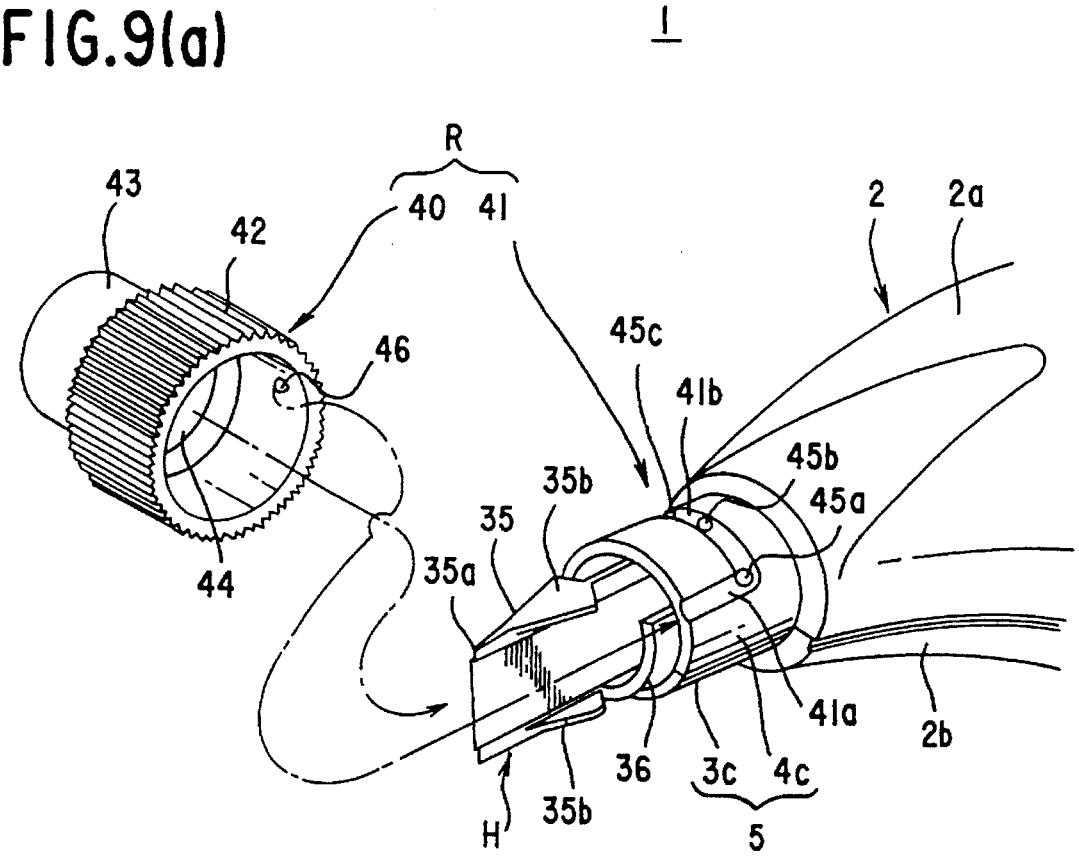
FIG. 9 is a perspective view showing the constitution of the rotative part, FIG. 9 (*a*) shows the relation between the coating film transfer head and rotative part, and FIG. 9 (*b*) shows a positioning part of the rotative part.
Figure 9B:
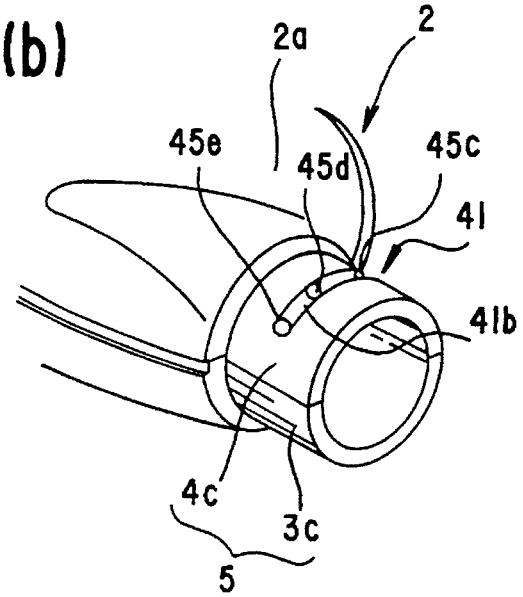

The positioning part 41 comprises, as shown in FIG. 8 and FIG. 9, a fit-in guide groove 41*a* extending straight in the axial direction of the cylindrical front end 5, and an anchor guide groove 41*b* extending from an end of the fit-in guide groove 41*a* in the circumferential direction of the cylindrical front end 5. In the embodiment shown, the anchor guide groove 41*b* is formed in a range of 90 deg. of central angle of the cylindrical front end 5, as shown in FIG. 8. In this anchor guide groove 41*b*, plural engagement parts 45 (five engagement parts 45*a* to 45*e* in the illustrated example) are provided at equal intervals.

The engagement parts 45*a* to 45*e* are formed as hemispherical recesses deeper than the guide grooves 41*a*, 41*b*. These engagement recesses 45*a* to 45*e* are disengageably engaged with an engagement projection (engagement part) 46 that is provided in an inner circumference of the cap member 40. That is, the engagement projection 46 is geometrically dimensioned such that the engagement projection 46 can be guided along the guide grooves 41*a*, 41*b*, while they are elastically changed in shape to some relative extent, and fitted in the engagement recesses 45*a* to 45*e* by elastic restoration.

The engagement configuration of the engagement projection 46 and engagement recesses 45*a* to 45*e* is determined as follows.

Figure 2:
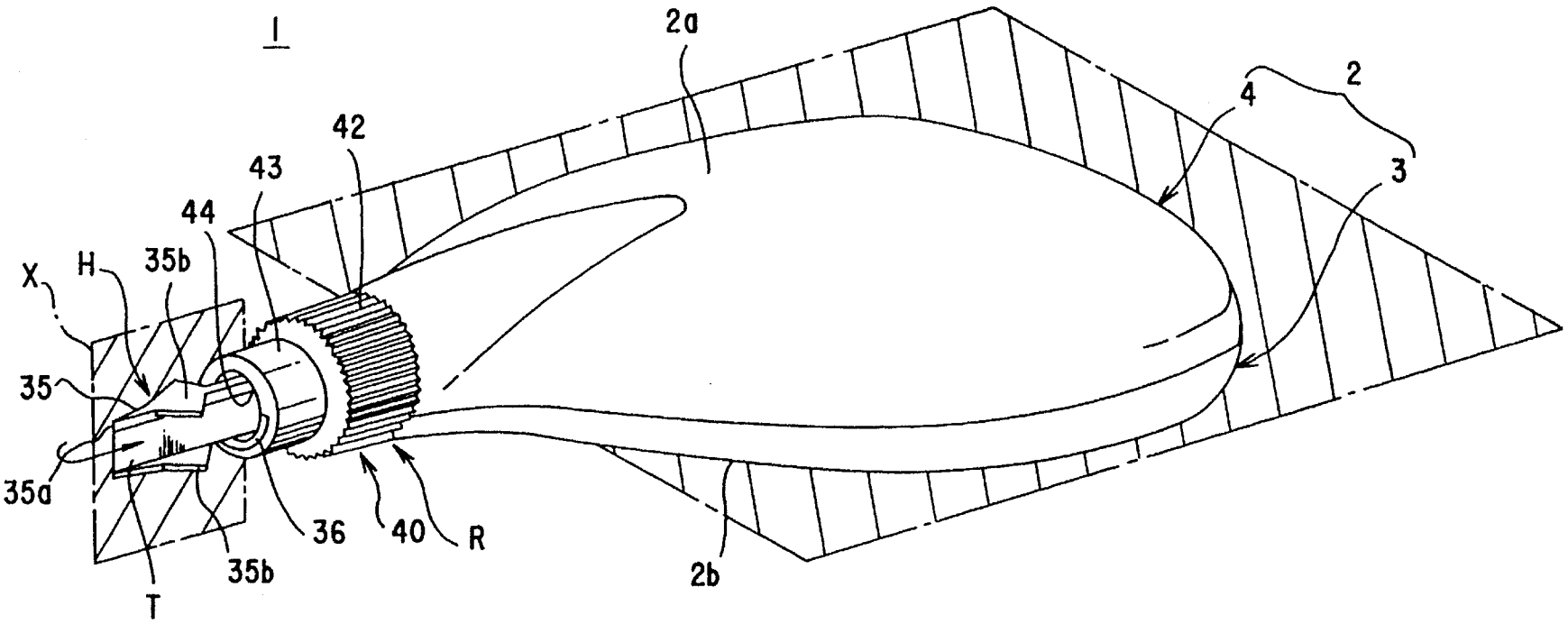
FIG. 2 is a perspective view of the erasing tool, showing a coating film transfer head in a vertical pulling operation basic position.
Figure 3:
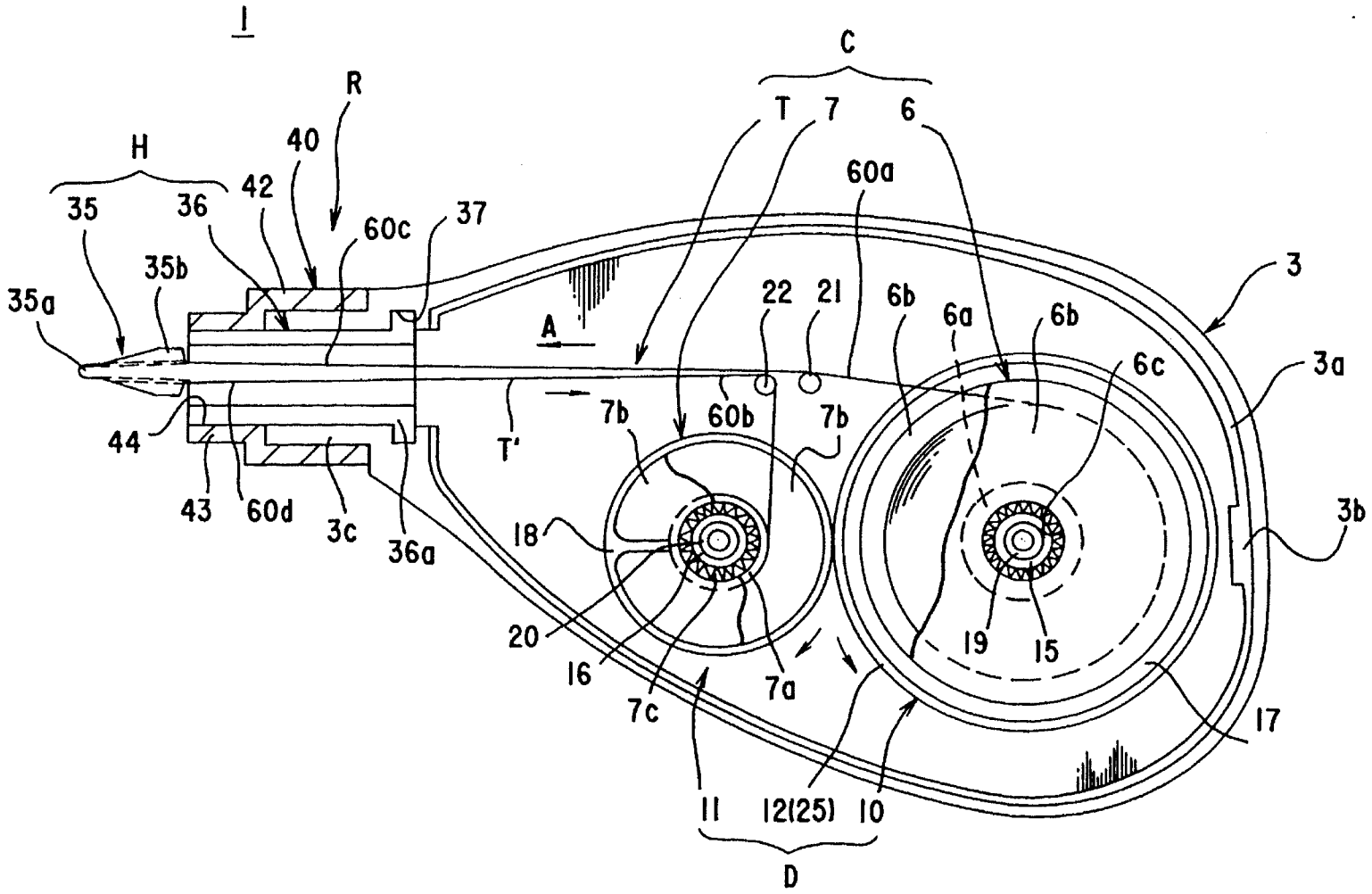
FIG. 3 is a front view showing the inside of the erasing tool in a partial sectional view, similarly showing the coating film transfer head in a vertical pulling operation basic position.

That is, when the engagement projection 46 of cap member 40 is in engagement with the first engagement recess 45*a*, the head H is, as shown in FIG. 2 and FIG. 3, in the vertical pulling operation basic operation (also coating film transfer tape replacement position) X. In such condition, the pressing part 35*a* in the front end of head H guides the coating film transfer tape T in a same attitude as it is wound about the pay-out reel 6 and winding reel 7, that is, with the front and back surfaces of coating film transfer tape T oriented approximately perpendicularly (orthogonal) to the gripping surfaces 2*a*, 2*b*.

Then, as shown in FIG. 3, the coating film transfer tape T paid out of the pay-out reel 6 is dragged past the pressing part 35*a* of head H by means of the guide pin 21, and wound about the winding reel 7 by means of the guide pin 22, while it is kept in that attitude.

Figure 4:
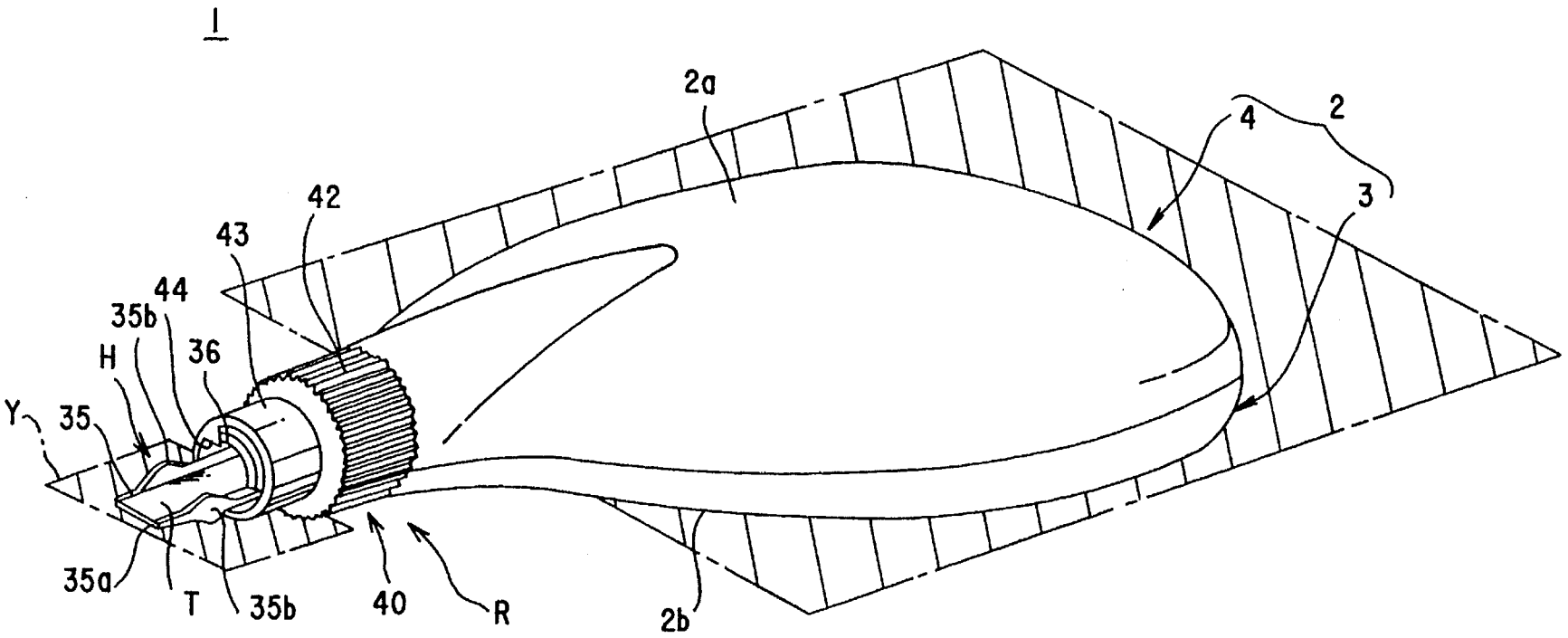
FIG. 4 is a perspective view of the erasing tool, showing the coating film transfer head in a lateral pulling operation basic position.
Figure 5:
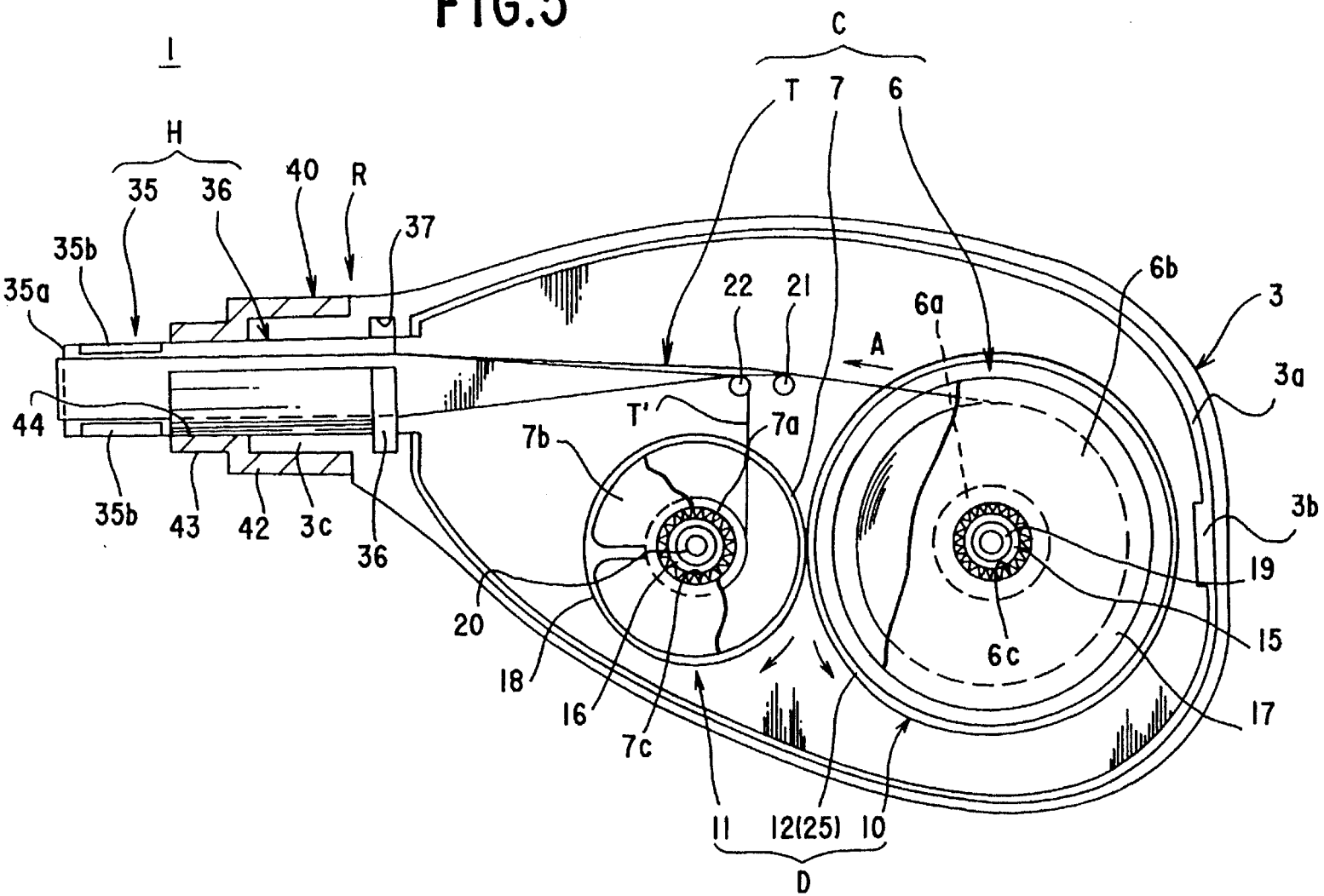
FIG. 5 is a front view showing the inside of the erasing tool in a partial sectional view, similarly showing the coating film transfer head in a lateral pulling operation basic position.

On the other hand, when the engagement projection 46 is in engagement with the fifth engagement recess 45*e* (see FIG. 8), the head H is, as shown in FIG. 4 and FIG. 5, in the lateral pulling operation position Y. In such condition, the pressing part 35*a* of head H guides the coating film transfer tape T by positioning it approximately directly faced to the gripping surfaces 2*a*, 2*b* of case 2, that is, with the front and back surfaces of coating film transfer tape T facing to the direction approximately same as that of (parallel to) the gripping surfaces 2*a*, 2*b*.

Therefore, the coating film transfer tape T paid out of the pay-out reel 6 is, as shown in FIG. 5, twisted through an angle of 90 deg. by the guide pin 21, then, dragged past the pressing part 35*a* in the front end of head H, untwisted to the original state now by the guide pin 22, and wound about the winding reel 7.

The engagement projection 46 may be also engaged with any one of the second to fourth engagement recesses 45*b* to 45*d*, so that the head H may have an appropriate angle position between the vertical pulling operation basic position X and lateral pulling operation basic position Y.

That is, by rotating the cap member 40, the head H is adjustable in angle in five steps between the vertical pulling operation basic position X and lateral pulling operation basic position Y.

The specific structure of the rotative part R is not limited to the illustrated example alone. For example, the positioning part 41 may be disposed in the semicylindrical part 3*c* of the case main body 3 also, and in such a case, moreover, a new engagement projection is additionaly provided in the cap member 40, corresponding to the positioning part 41.

Operation of the erasing tool 1 constructed in such manner is described below.

Figure 10A:
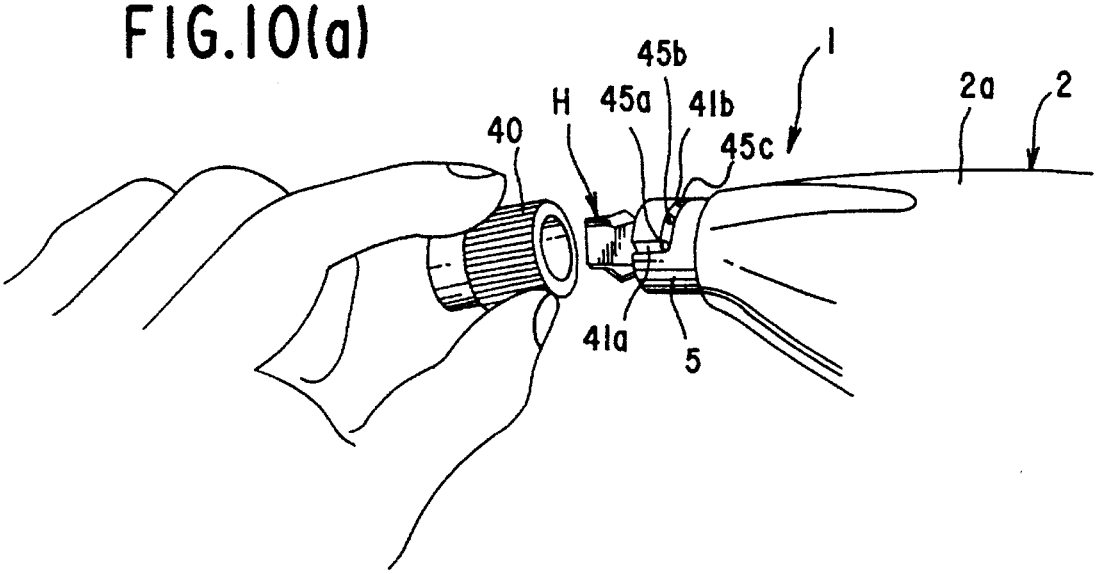
FIG. 10 is a perspective view for explaining the operating procedure of the rotative part, FIG. 10 (*a*) shows the state of attaching or detaching a cap member to or from a cylindrical front end portion of a case, and FIG. 10 (*b*) shows the state of rotating the cap member.
Figure 10B:
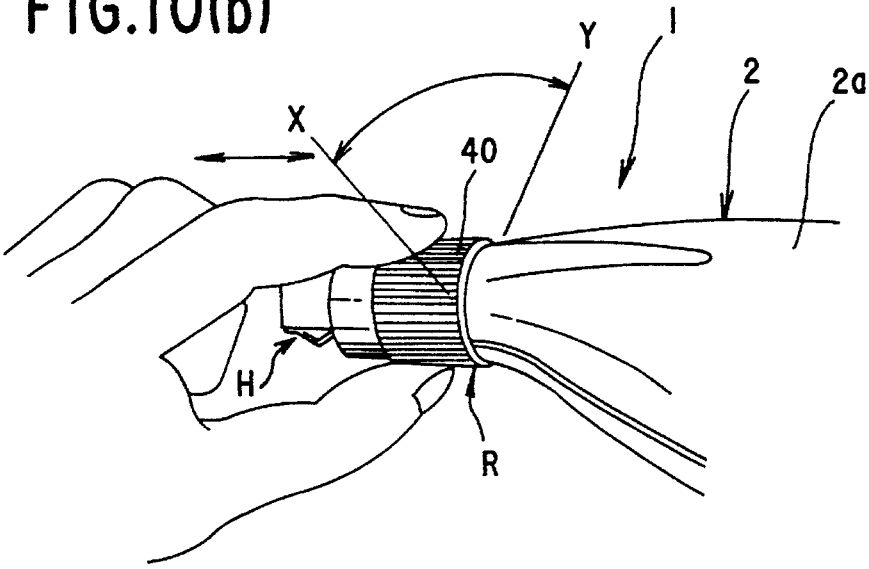

A. Operation:

By rotating the cap member 40 (see FIG. 10 (*b*)), the head H is selectively positioned in one of the five angle positions between the vertical pulling operation position X (in which the engagement projection 46 of the cap member 40 comes into engagement with the first engagement recess 45*a*) and lateral pulling operation position Y (in which the engagement projection 46 comes into engagement with the fifth engagement recess 45*e*), thereby allowing to be used in the following manners.

Figure 11A:
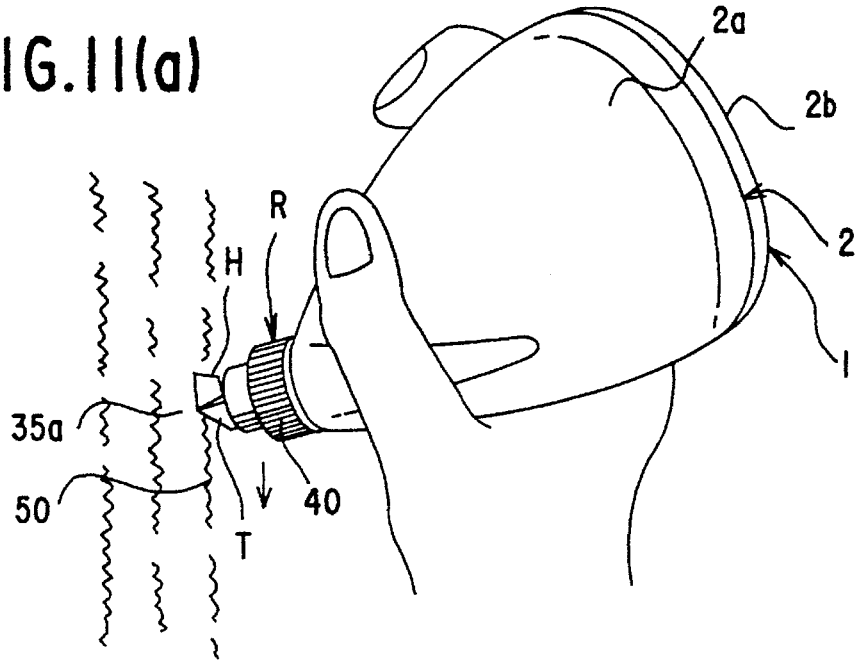
FIG. 11 is a perspective view for explaining the method of using the erasing tool, FIG. 11 (*a*) shows a vertical pulling state, and FIG. 11 (*b*) shows a lateral pulling state.
Figure 11B:
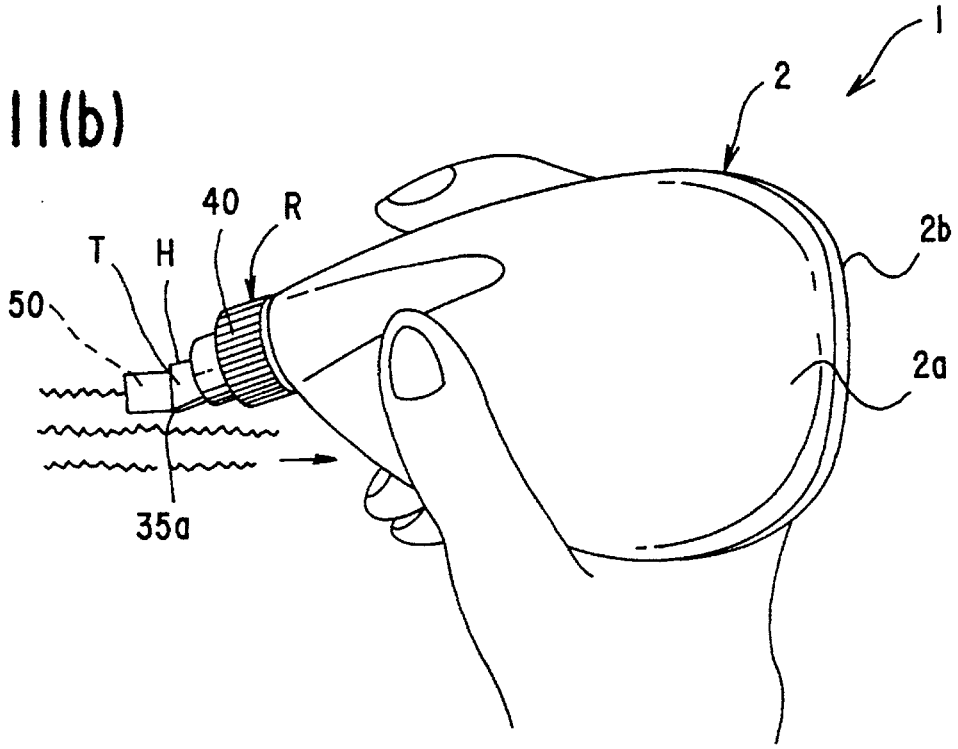

That is, for so-called vertical pulling use, basically, the head H is adjusted in angle to the vertical pulling operation basic position X (see FIG. 2). On the other hand, for so-called lateral pulling use, basically, the head H is adjusted in angle to the lateral pulling operation basic position Y (see FIG. 4). Besides, depending on the user's manner of holding a writing tool (in the case of a peculiar personal habit, etc.), the head H is adjusted in angle at an appropriate handling position between the both basic positions X, Y.

i) Vertical pulling use:

This is suitable for partially correcting a sentence vertically written, for example, in Japanese. As shown in FIG. 11 (*a*), the user grips the case 2 by the gripping surfaces 2*a*, 2*b* with fingers like holding a writing tool, and, in this state, fits the pressing part 35*a* in the front end of head H to the starting end (upper end) of a correction area (transfer area) 50 where an error or the like is present in a sheet. In this state, the case 2 is moved vertically or downward in relation to the sheet surface (to the arrow direction), and stopped when the pressing part 35*a* in the front end reaches the terminal end (lower end) of the correction area 50.

In such operation, the corrective paint layer (white) of coating film transfer tape T in the pressing part 35*a* of head H is separated from the base film, and transferred to cover the correction area 50, the error or the like is thereby erased, and a correct letter can be readily written on the corrective paint layer. At this time, meanwhile, since the head H follows up to a certain extend in the direction of action of force owing to its own elastic force, the coating film transfer tape T is pressed tightly to the correction area 50 by the front end pressing part 35*a* of the head H.

ii) Lateral pulling use:

This is suitable for partially correcting a sentence laterally written, for example, in English. As shown in FIG. 11 (*b*), the user grips the case 2 by the gripping surfaces 2*a*, 2*b* like holding a writing tool, and, in this state, fits the pressing part 35*a* of the head H to the starting end (left end) of a correction area 50, as described above, Then, by moving the case 2 laterally or rightward in relation to the sheet surface (to the arrow direction) until it reaches the terminal end (right end) of the correction area, an error or the like is erased, and again a correct letter can be readily written.

iii) Erasing a narrow area:

When erasing a narrow area, for example, a tiny character or one letter in a sentence, the terminal end of the correction area 50 is concealed by the head H and is hardly visible, and it is difficult to erase a desired character only securely.

Figure 12A:
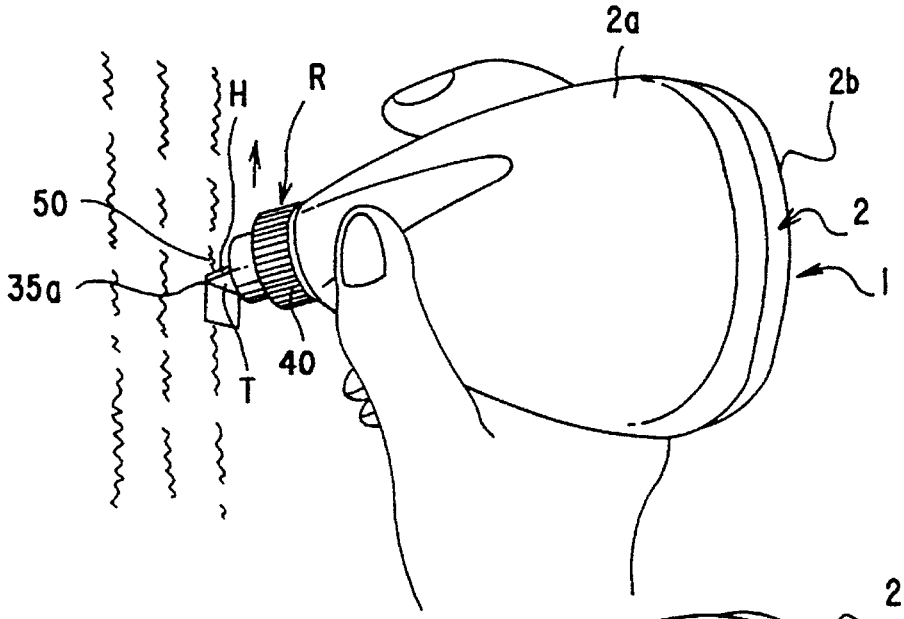
FIG. 12 is a perspective view for similarly explaining the method of using the erasing tool, FIG. 12 (*a*) shows a vertical pushing state, and FIG. 12 (*b*) shows a lateral pushing state.
Figure 12B:
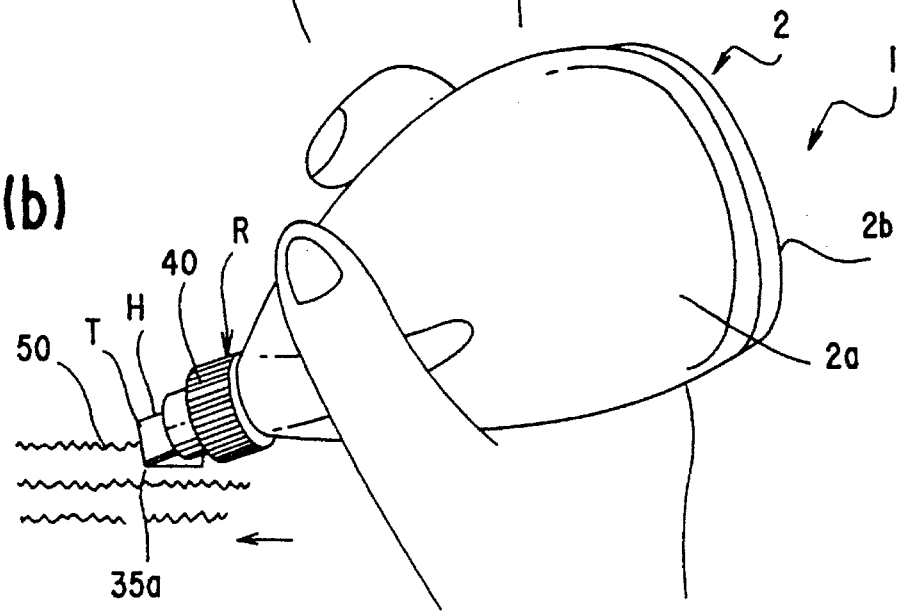

In such a case, the user grips the case upside down of the method of use in i) or ii). Then, as shown in FIG. 12 (*a*) or FIG. 12 (*b*), by pushing the case 2 in the reverse direction (arrow direction), only the desired character can be erased without failure.

B. Replacement of tape cartridges C:

When the entire length of coating film transfer tape T is used, and wound by the winding reel 7 for collection from the pay-out reel 6, the tape cartridge C should be replaced with a new one according to the following steps.

i) Bring the head H into the coating film transfer tape replacement attitude or the vertical pulling operation basic position X. By such operation, the coating film transfer tape T on the head H comes to be parallel to the winding attitude of the pay-out and winding reels 6, 7 as shown in FIG. 3, so that the coating film transfer tape T can be easily detached from the head H.

ii) Disassemble the case 2 open. In this operation, firstly, pull the cap member 40 off the cylindrical front end 5 of case 2, as shown in FIG. 10 (*a*), then, with the cap body 4 facing upward, lift the semicylindrical part 4*c* to remove the cap body 4 from the case main body 3.

iii) Firstly, remove the used cartridge C (empty pay-out reel 6 and winding reel 7 with the used coating film transfer tape T' collected thereabout), then, place a virgin tape cartridge C (pay-out reel 6 with a new coating film transfer tape T and winding reel 7) onto the tape drive unit D, and set the coating film transfer tape T through the pressing part 35*a* in the front end of head H.

In this operation, by maintaining the coating film transfer tape T in such attitude as it is wound about the pay-out reel 6 and winding reel 7 as shown in FIG. 1, drag vicinities 60*a*, 60*b* of the paid-out and wound portions through the guide pins 21, 22, and insert front parts 60*c*, 60*d* of the tape in both sides of the head body 35 of head H from the upper side.

By such operation, as shown in FIG. 3, the coating film transfer tape T is inverted through the pressing part 35*a* of head H by means of the guide pin 21, after it is paid out of the pay-out reel 6, and set in such attitude as it is wound about the winding reel 7 by the guide pin 22.

Incidentally, the head H may be once removed from the cylindrical front end 5, and reattached after the sequential steps are performed.

iv) Then, the case 2 is closed, and reassembled. Here, the case 2 can be assembled by firstly bringing the engagement claw 4*b* of capping body 4 into engagement with the engagement part 3*b* of case main body 3, then, mating the semicylindrical part 4*c* with the semicylindrical part 3*c* of case main body 3 (the mating recess 3*a* comes into engagement with the mating rib 4*a*, accordingly), and inserting the cap member 40 to fit in the integrated cylindrical front end 5, as shown in FIG. 10 (*a*).

Embodiment 2

Figure 13:
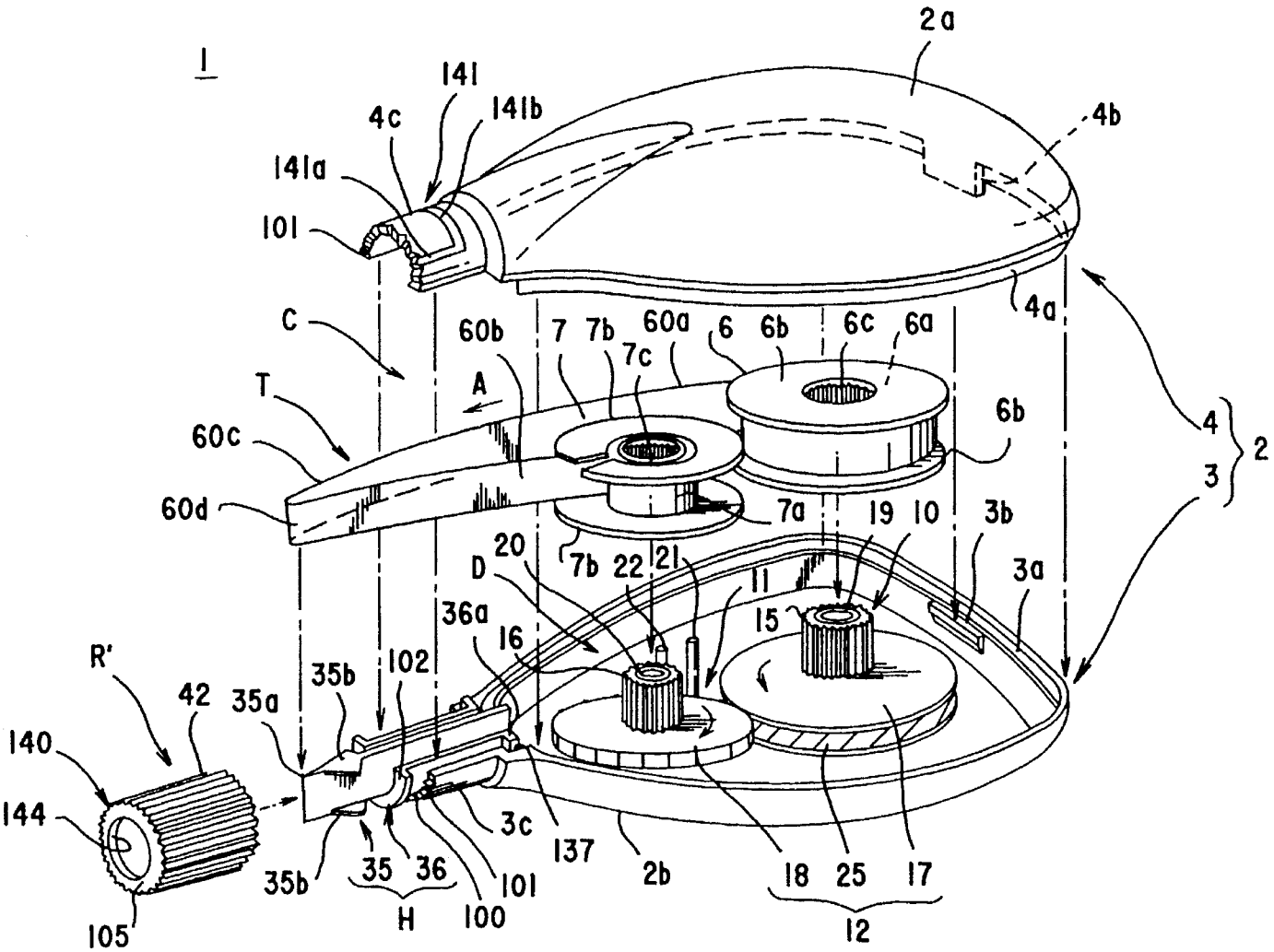
FIG. 13 is an exploded perspective view of an erasing tool in embodiment 2 of the invention.
Figure 14A:
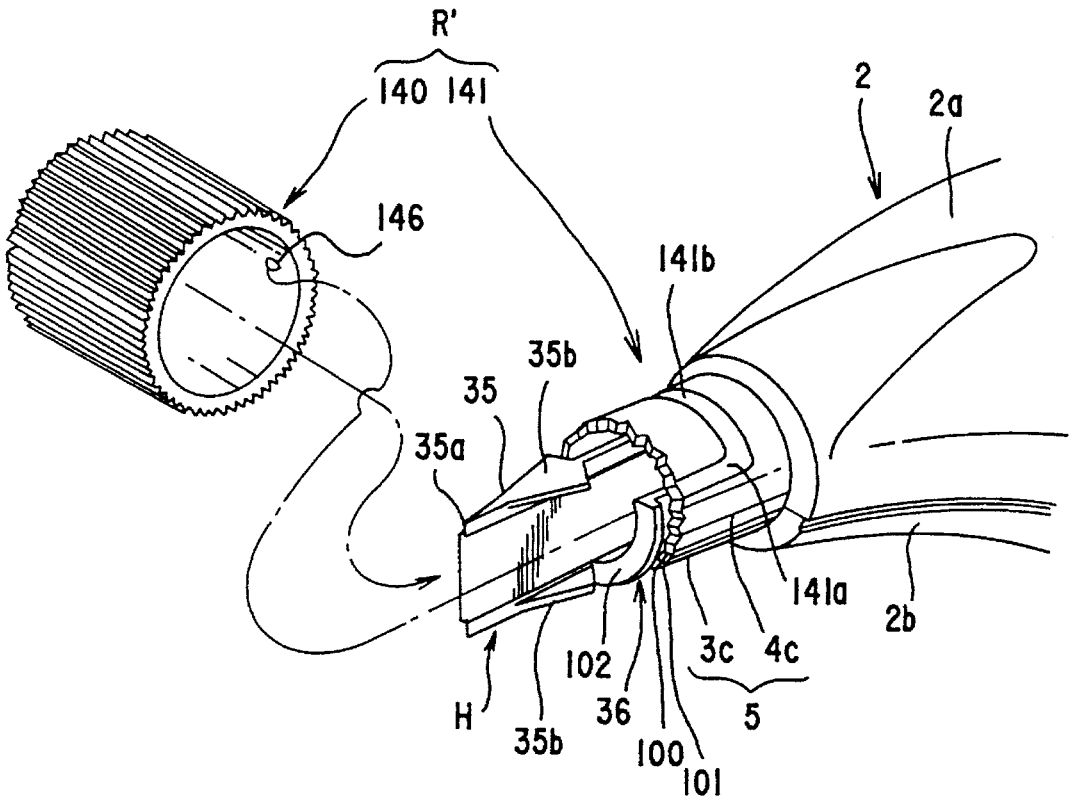
FIG. 14 is a perspective view showing the constitution of a rotative part of the erasing tool, FIG. 14 (*a*) shows a coating film transfer head and cylindrical front end portion of a case, in a cap member detached state, and FIG. 14 (*b*) shows the cylindrical front end portion.
Figure 14B:
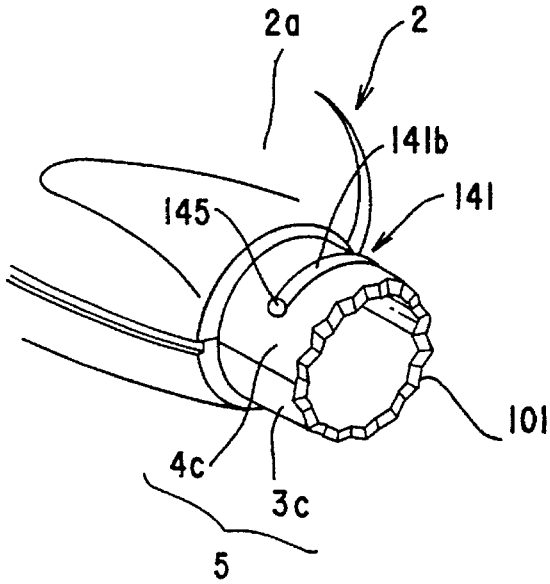

This embodiment is shown in FIG. 13 to FIG. 15, and it is constructed so that the angle position of the head H relative to the case 2 adjustable in multiple steps.

A rotative part R' in this embodiment comprises a pair of engagement portions 100, 101 provided in both head H and cylindrical front end 5 of the case 2, and a cap member 140 for fixing the positioning of the engagement state of these engagement portions 100, 101.

The engagement portion 100 of the head H is provided in a bearing part 36 rotatably supported at the cylindrical front end 5. That is, at the front end of the bearing part 36, an outward flange 102 is provided integrally, and on the back side of this outward flange 102, that is, on the side confronting the front end surface of the cylindrical front end 5, the engagement portion 100 is formed. On the other hand, the engagement portion 101 of the cylindrical front end 5 is provided on its front end surface.

These engagement portions 100, 101 are shaped in triangular concave and convex surfaces, formed of slopes alternately inclining in the circumferential directions of the both surfaces as shown in FIG. 14 (*a*) and (*b*). The concave and convex surfaces of these engagement portions 100, 101 are mutually engaged in the circumferential direction or rotating direction, so that the angle position in the circumferential direction of the head H relative to the cylindrical front end 5 is positioned.

That is, by rotating the head H, the engagement position of the engagement portion 100 with the engagement portion 101 of the cylindrical front end 5 is properly adjusted. As a result, the angle position of the head H relative to the case 2 can be adjusted not only at the vertical pulling operation basic operation (also coating film transfer tape replacement position) X shown in FIG. 2 or lateral pulling operation basic position Y in FIG. 5, but also in multiple steps between them. The number of steps of angle adjustment is determined by the number of concave and convex surfaces of the engagement portions 100, 101.

Moreover, as shown in FIG. 13 and FIG. 15, in relation to the arcuate flange 36*a* of the base end of the bearing part 36, in the cylindrical front end 5, that is, in the base inner circumference of the both semicylindrical portions 3*c*, 4*c*, stopping steps 137 are individually formed. As the arcuate flange 36*a* fits into these stopping steps 137, 137, the head H is prevented from slipping out.

The cap member 140 is a plastic integral part detachably attached to the outer circumference of the cylindrical front end 5. The cap member 140 has both a function as assembly fixing member of the case 2, and a function of engagement fixing member for fixing the engaged state of the engagement portions 100, 101.

The inner diameter of the cap member 140 is set so as to be placed and rotatable on the outer circumference of the cylindrical front end 5, and multiple toothed anti-slide ribs are formed on the outer circumference of the cap member 140. At the front end of the cap member 140, an inward flange 105 is provided, and this inward flange 105 is engaged with the outward flange 102 of the coating film transfer head H (see FIG. 15). An insertion hole 144 is formed from an inner edge of the inward flange 105. This insertion hole 144 is for passing the head H, and its shape and dimensions are formed in a circular form corresponding to the contour of the portion of the head body 35 of the head H.

On the outer circumference of the cylindrical front end 5, more specifically on the outer circumference of the semicylindrical part 4*c* of the cap body 4, a fixing part 141 for engaging and fixing the cap member 40 is provided. This fixing part 141 comprises, same as the positioning part 41 in Embodiment 1 as shown in FIG. 13 and FIG. 14, an insertion guide groove 141*a* extending linearly in the axial direction of the cylindrical front end 5, and an anchor guide groove 141*b* extending in the circumferential direction of the cylindrical front end 5 from one end of the insertion guide groove 141*a*.

The forming position of the anchor guide groove 141*b* is set, as shown in FIG. 15, so that the inward flange 105 of the cap member 140 may press the outward flange 102 of the head H to the inner side of the axial direction until the engagement portion 100 is tightly engaged with the engagement portion 101 of the cylindrical front end 5, in the state of the engagement projection 145 of the cap member 140 (FIG. 14 (*a*)) being engaged with the anchor guide groove 141*b*.

At the terminal end of the anchor guide groove 141*b*, an engagement portion 145 (FIG. 14 (*b*)) is provided. This engagement portion 145 is in a hemispherical recess form deeper than the guide grooves 141*a*, 141*b*. In this engagement recess 145, a hemispherical engagement projection 146 provided on the inner circumference of the cap member 140 is elastically engaged detachably. The shape and dimensions of the engagement recess 145 and engagement projection 146 are set in the same conditions as the engagement recess 45 and engagement projection 46 in Embodiment 1.

When using thus constituted erasing tool 1, first, the head H is properly rotated to adjust the engagement position of the engaging portions 100, 101, and the head H is positioned at a desired angle position then, the cap member 140 is externally fixed on the cylindrical front end 5 (with the engagement projection 145 of the cap member 140 being elastically engaged with the engagement recess 145 of the anchor guide groove 141*b*). As a result, the engagement portion of the head H is engaged and fixed in the cylindrical front end 5 of the case 2, and the head H is positioned and fixed at the desired angle position.

In this embodiment, since the both engagement portions 100, 101 are formed annularly over the entire circumference, the angle adjustment range of the coating film transfer head H is far wider than 90 deg. in Embodiment 1 (although actually limited by the twist allowable angle of the coating film transfer tape T, theoretically 360 deg.). Hence, not only in the vertical pulling use or lateral pulling use mentioned in FIG. 11 (*a*), (*b*), but also in vertical pulling use or lateral pulling use as in FIG. 12 (*a*), (*b*), the user can grip the erasing tool 1 without turning the case 2 upside down as in Embodiment 1. The other constitution and action are same as in Embodiment 1.

Embodiment 3

Figure 17:
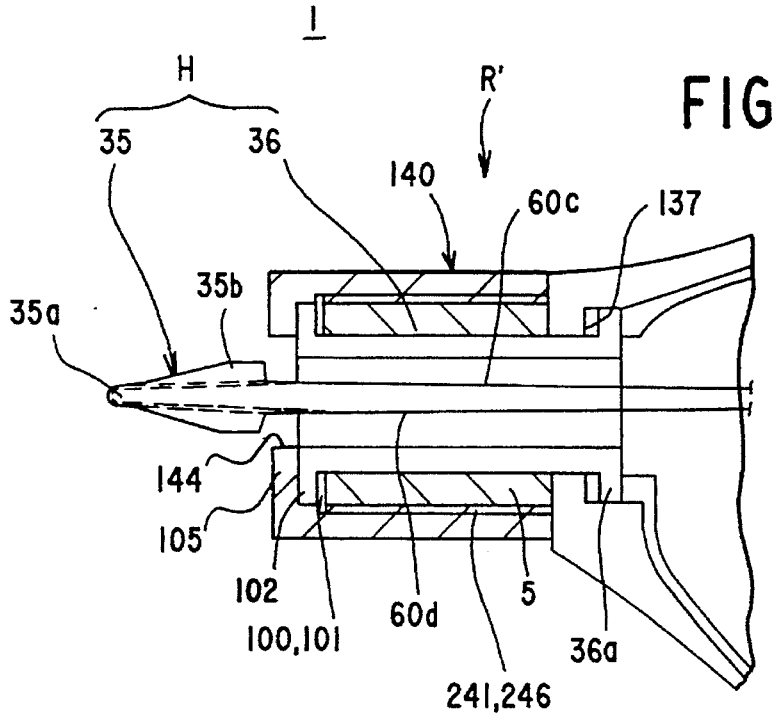
FIG. 17 is a magnified side view showing the constitution of the rotative part in a partial section.

This embodiment is shown in FIG. 16 and FIG. 17. In this erasing tool 1, the structure of the rotative part R' in Embodiment 2 is slightly modified, and the engaging and fixing structure of the cap member 140 and cylindrical front end 5 is a screw-in structure.

That is, the cylindrical front end 5 is integrally formed as shown in FIG. 16, and a male thread portion 241 is provided on the outer circumference there of. On the other, in the inner circumference of the cap member 40, a female thread portion 246 to be engaged with the male thread portion 241 is provided.

Therefore, after adjusting the head H in the desired angle position by adjusting the engagement position of the engagement portions 100, 101, the cap member 140 is screwed and fixed into the cylindrical front end 5, and the both engagement portions 100, 101 are engaged and fixed with each other, and the head H is positioned and fixed at the desired angle position. The other constitution and action are same as in Embodiment 2.

Embodiment 4

Although this embodiment is not shown in the drawing, in this erasing tool 1, the both engagement portions 100, 101 in Embodiment 2 or Embodiment 3 are formed on mutually confronting flat planes, and the angle position of the head H to the case 2 is adjustable steplessly. The other constitution and action are same as in Embodiment 2 or Embodiment 3.

Embodiment 5

Figure 18:
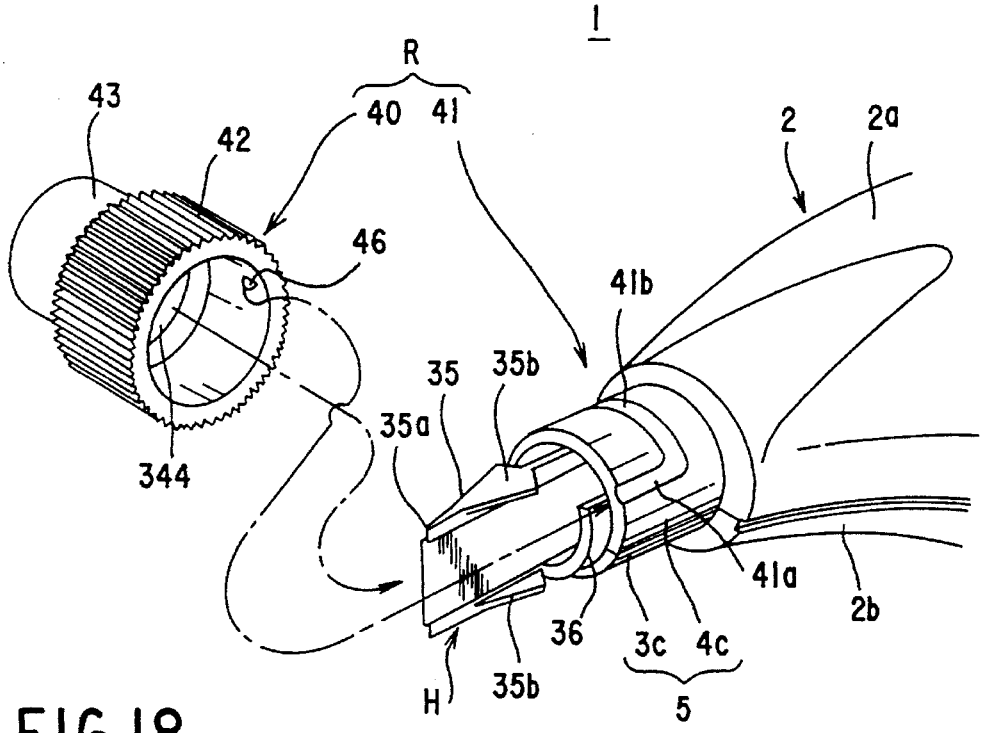
FIG. 18 is an exploded perspective view showing the constitution of a rotative part of an erasing tool according to embodiment 5 of the invention, in a cap member detached state.

This embodiment is shown in FIG. 18 and FIG. 19. In this erasing tool 1, the head H is freely rotatable, and its angle position varies freely relatively to the case 2 depending on the force of action, and specifically the structure of the rotative part R in Embodiment 1 is slightly modified.

That is, the cap member 40 detachably mounted on the cylindrical front end 5 of the case 2 has only the function as assembly fixing member of the case 2. In an insertion hole 344 provided at the fitting portion 43 of the cap member 40, same as in the insertion hole 144 in Embodiment 2 or 3, the head H can be inserted, and this head H is formed in a rotatable circular form. A positioning part 41 provided on the outer circumference of the cylindrical front end 5 is to be engaged and fixed with the cap member 40, and therefore the engagements 45*a* to 45*e* of the anchor guide groove 41*b* in Embodiment 1 are omitted.

When using thus constituted erasing tool 1, the user grips the case 2 by the gripping surfaces 2*a*, 2*b* with fingers as if holding a writing tool, and fits the pressing part 35*a* of the head H to the starting end of a correction area 50 on the surface of a sheet of paper for correcting a wrong letter or the like, as shown in FIG. 11 of FIG. 12, and moves the case 2 as it is toward the terminal end of the correction area 50.

At this time, the head H follows the direction of action of the force, and rotates freely about its axial center, and its angle position is properly adjusted. Accordingly, the coating film transfer tape T is always pressed tightly onto the correction area 50 by the pressing part 35*a* of the head H, and the wrong letter or the like is erased securely. In this structure allowing the head H to rotate freely by following in the direction of action of the force, it is possible to correct not only a linear portion such as an array of characters, but also a curved portion such as a graphic pattern.

Embodiment 6

Figure 21A:
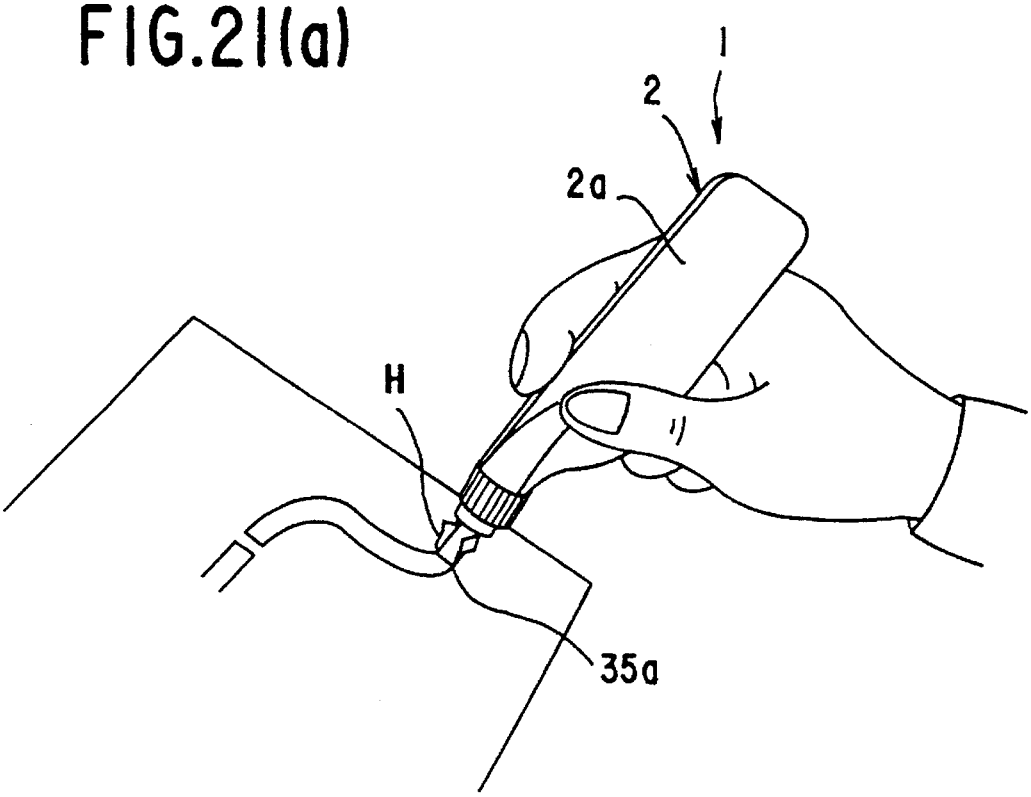
FIG. 21 is a perspective view showing the state of use of the erasing tool, and FIG. 21 (*a*) and FIG. 21 (*b*) show the manner of holding the case in different positions.
Figure 21B:
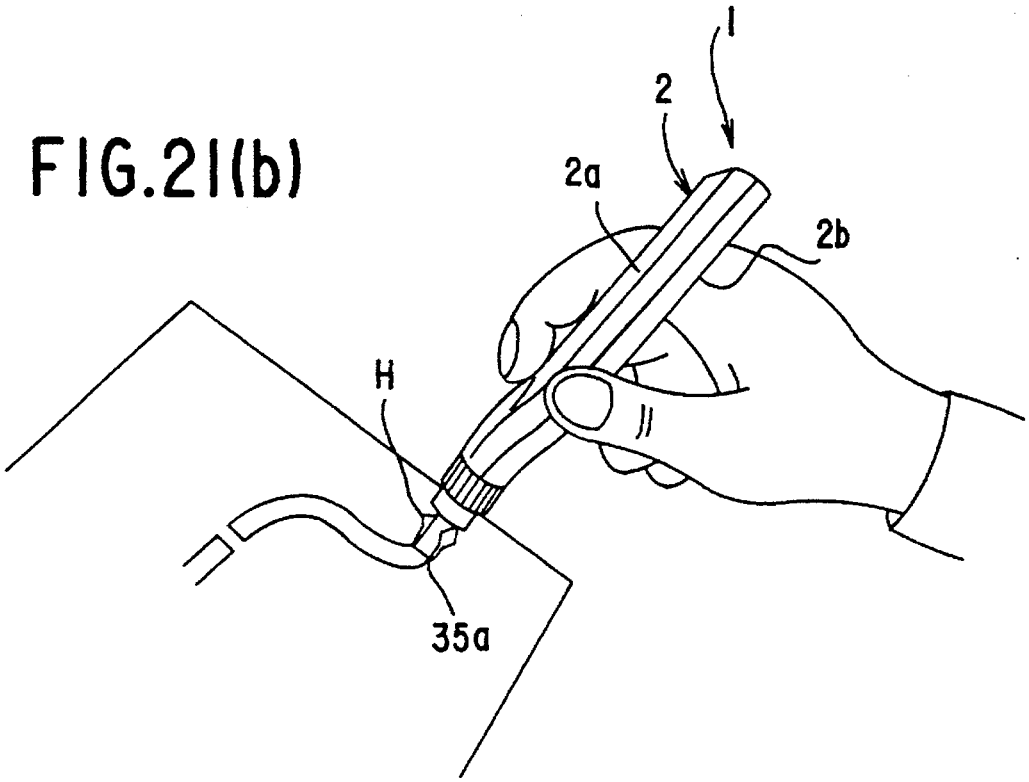

This embodiment is shown in FIG. 20 and FIG. 21. In this erasing tool 1, same as in Embodiment 5, the head H rotates freely, and its angle position changes freely relative to the case 2 depending on the force of action.

In this erasing tool 1, the shape and dimensions of the case 2 are set so as to enhance the peculiar function of Embodiment 5, that is, the function of correcting a curved portion of graphic pattern or the like, aside from a linear portion such as an array of characters.

That is, the case 2 has a slender front contour shape as compared with the foregoing embodiments as shown in FIG. 20. Accordingly, the user can hold and manipulate the erasing tool 1 as if holding a pencil or other better writing tool, with a better writing tool-like feeling than that of the foregoing embodiments. Corresponding to this, the tape cartridge C and tape drive unit D incorporated in the case 2 are reduced in size.

In thus constituted erasing tool 1, depending on the manner of holding the writing tool by individual users, a holding method as shown in either FIG. 21 (*a*) or FIG. 21 (*b*) is possible. Moreover, according to this erasing tool 1, as shown in the drawing, for example, a curved portion such as graphic figure can be corrected securely along the curve. The other constitution and action are same as in Embodiment 5.

In the foregoing Embodiments 1 to 6, for example as the coating film transfer tape T, by using a structure of forming an adhesive layer through a release agent layer on one side of a film base material, it may be also used as a gluing tool to transfer only the adhesive layer on the sheet surface or the like.

Figure 22A:
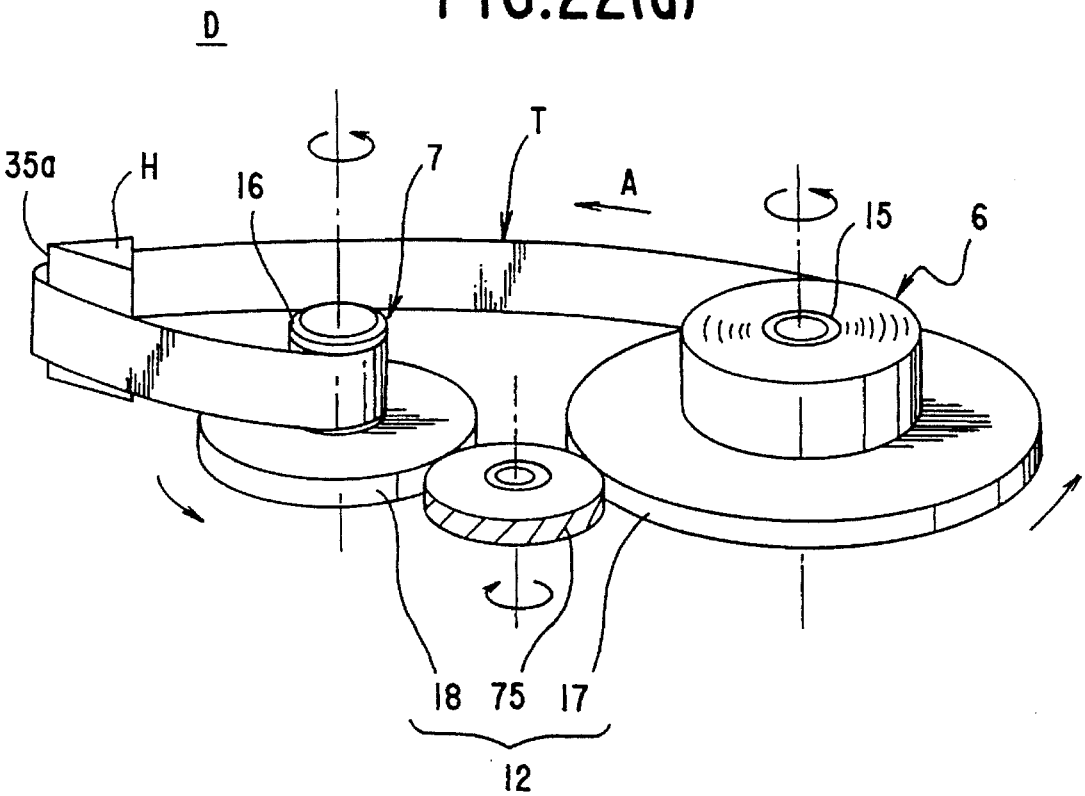
FIG. 22 is a schematic perspective view corresponding to FIG. 6, showing modified examples of the tape drive unit, FIG. 22 (*a*) shows a first modified example, and FIG. 22 (*b*) shows a second modified example.
Figure 22B:
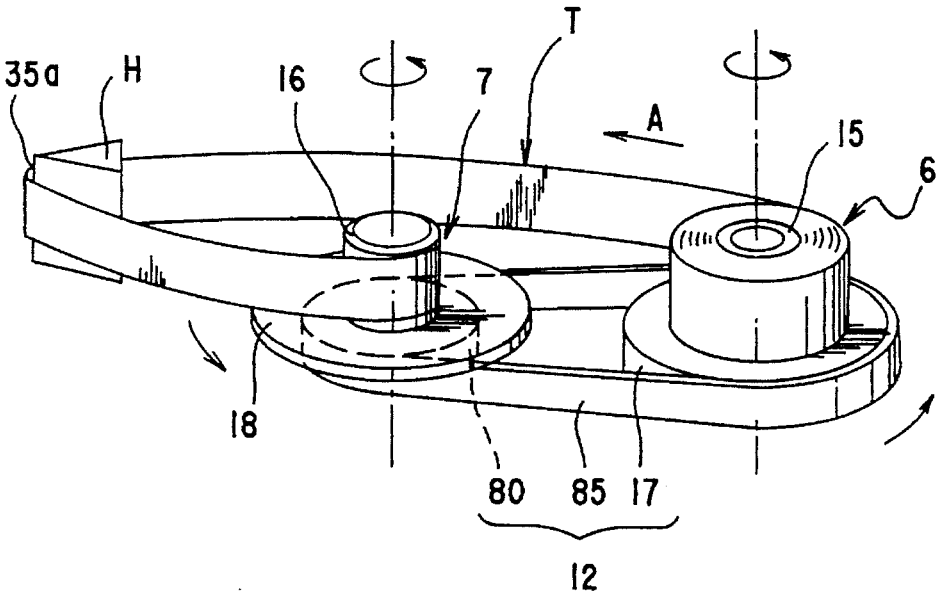
Figure 24:
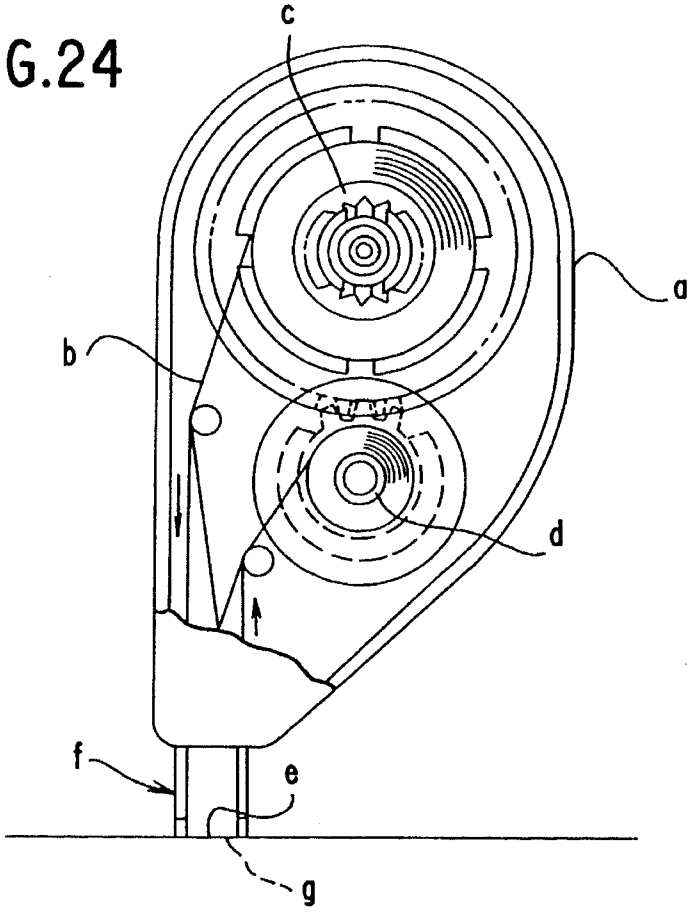
FIG. 24 is also a front view showing a partially cut-away view of an internal constitution of a different conventional erasing tool.
Figure 23:
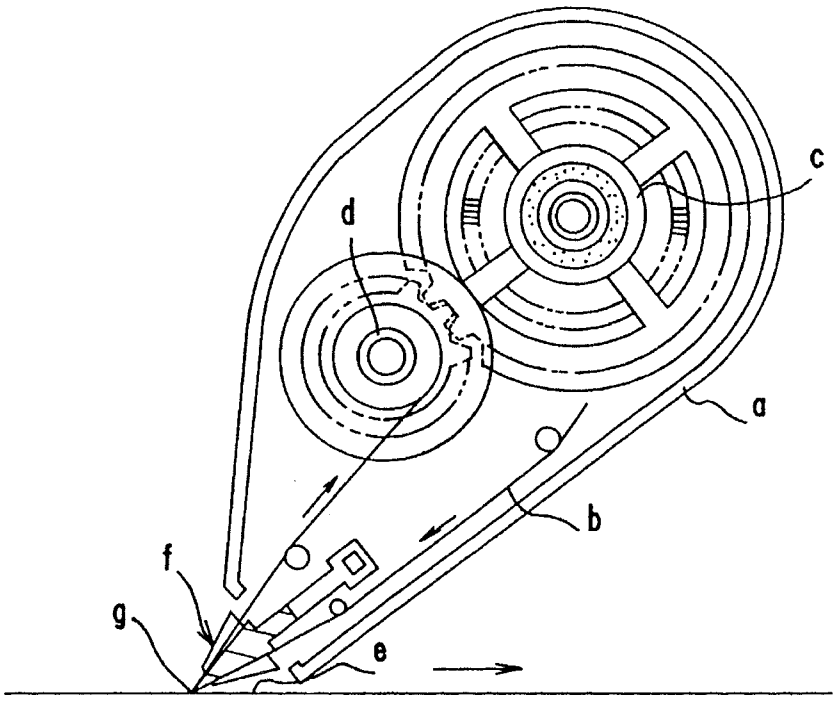
FIG. 23 is a front view showing a partially cut-away view of an internal constitution of a conventional erasing tool.

As the interlocking part 12, incidentally, instead of the structure shown in FIG. 6, a structure as shown in FIG. 22 (*a*) or FIG. 22 (*b*) may be also employed.

That is, the interlocking part 12 shown in FIG. 22 (*a*) comprises rotating disks 17, 18 composing part of the rotating winding part 11 and rotating pay-off part 10 respectively, and a frictional wheel 75. In the frictional wheel 75, specifically, at least the outer circumference is formed of a frictional material such as silicone rubber. The frictional wheel 75 is rotatably provided at the inner side of the case main body 3 between the both rotating disks 17, 18, and the outer circumference there of is frictionally engaged with the outer circumference of the rotating disks 17, 18 respectively.

On the other hand, the interlocking part 12 shown in FIG. 22 (*b*) comprises the rotating disk 17, a rotation transmitting part 80 concentrically provided at the lower side of the rotating disk 18, and an endless belt 85. This endless belt 85 is specifically formed of soft plastic such as silicone rubber, and is wound on so as to frictionally contact with the outer circumference of the both rotating disk 17 and rotation transmitting part 80.

Furthermore, the interlocking part 12 in all illustrated examples is structured to have both a rotation transmitting function and a sliding function, but the two functions may be provided separately and independently as disclosed in Japanese Laid-open Utility Model No. 5-13800 or Japanese Laid-open Patent No. 5-58097.

All embodiments illustrated so far relate to the automatic winding type in which the winding reel 7 cooperates with the pay-out reel 6, but the invention may be also applied in the-coating film transfer tool of manual winding type of the winding reel 7 having a separate manual winding dial. Moreover, the invention may be also applied in the disposable type having no structure for replacing the coating film transfer tape T, aside from the cartridge type or refill type shown in the illustrated embodiments.

According to the invention, as mentioned above, since the coating film transfer head for pressing the coating film transfer tape onto the transfer area is adjustable in angle about its axial line, the user can adjust the angle of the head depending on the application or the own manner of holding the writing tool. Therefore, whether the user has a peculiar personal habit of holding a writing tool or not, whether in vertical pulling use or in lateral pulling use, all users can grip the case of the coating film transfer tool with a writing tool-like feeling, and press the coating film transfer tape tightly onto the sheet surface or the like by the pressing part of the head, so that the ease of operation is excellent.

In addition, since the head is free to rotate about its axial line, the head rotates freely by following the direction of action of force, and its angle is properly adjusted. As a result, the coating film transfer tape is always pressed tightly onto the transfer area by the pressing part of the head. What is more, when the head is structured to rotate freely by following the direction of action of force, not only the linear portion of an array of characters but also the curved portion of a graphic pattern can be corrected securely.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A coating film transfer tool comprising:

operating means configured and dimensioned for allowing hand-held operation by one hand;

tape pay-out means provided in the operating means for paying out a coating film transfer tape for supply;

tape pressing means projecting from a front end of the operating means for pressing the coating film transfer tape supplied by the tape pay-out means against a transfer area; and tape collecting means provided in the operating means for collecting the coating film transfer tape guided through a pressing part in a front end of the tape pressing means after it is used, wherein the front end pressing part of the tape pressing means is adjustable in angle about its axial center.

2. A coating film transfer tool comprising:

a case configured and dimensioned for allowing hand-held operation by one hand;

a pay-out reel rotatably provided in the case, and having a coating film transfer tape wound thereabout;

a coating film transfer head projecting from a front end of the case for pressing the coating film transfer tape against a transfer area; and a winding reel rotatably provided in the case for collecting the coating film transfer tape after use, wherein the head is adjustable in angle about its axial center.

3. A coating film transfer tool according to claim 2, wherein the head is mounted rotatably about the axial center on an inner circumference of the front end of the case, and a rotative part for rotating the head is provided at the front end of the case.

4. A coating film transfer tool according to claim 3, wherein the rotative part comprises a cap member fitted over a cylindrical front end of the case for rotation about an axis thereof, and a positioning part provided in an outer circumference of the cylindrical front end resiliently positioning the rotating direction position of the cap member in plural steps or steplessly, and fixing it in position;

the cap member is provided with a through hole for receiving the head; and the through hole is configured and dimensioned such that the cap member and the head are integrally engaged with each other in the rotating direction, when the head is received in the hole.

5. A coating film transfer tool according to claim 3, wherein the head is adjustable in angle in plural steps, at least between the angle for the front end pressing part to guide the coating film transfer tape in a same attitude as it is wound about the pay-out reel and winding reel, and the angle for guiding the coating film transfer tape nearly opposite to the gripping surfaces of the case.

6. A coating film transfer tool according to claim 2, wherein the head comprises an engagement portion provided rotatably about the axial center an an inner circumference of the front end of the case, to be engaged with the front end in the rotating direction, and the engagement portion of the head is engaged and fixed in the front end of the case, with the cap member being externally fitted and fixed on an outer circumference of the front end of the case.

7. A coating film transfer tool according to claim 6, wherein the head is adjustable in angle in plural steps, at least between the angle for the front end pressing part to guide the coating film transfer tape in a same attitude as it is wound about the pay-out reel and winding reel, and the angle for guiding the coating film transfer tape nearly opposite to the gripping surfaces of the case.

8. A coating film transfer tool according to claim 2, wherein the head is provided rotatably about the axial center on an inner circumference of the front end of the case, and is freely rotatable, at least between an angle for the front end pressing part to guide the coating film transfer tape in a same attitude as it is wound about the pay-out reel and winding reel, and the angle for guiding the coating film transfer tape nearly opposite to the gripping surfaces of the case.

9. A coating film transfer tool according to claim 2, wherein the case is formed in a flat box shape having a geometric and widthwise dimensions for containing the pay-out reel and the winding reel, and flat front and back surfaces thereof provides gripping surfaces.

10. A coating film transfer tool according to claim 2, wherein the case is a slender box having a contour shape and size for incorporating the pay-out reel and winding reel.

11. A coating film transfer tool according to claim 2, wherein a rotating pay-out part to which the pay-out reel is detachably mounted and a rotating winding part to which the winding reel is detachably mounted are rotatably provided in the case, respectively; and the both rotating parts are interconnected by an interlocking part, and the rotating winding part is of an automatic winding structure that is driven in a dependent relationship with the rotating pay-out part.

12. A coating film transfer tool according to claim 11, wherein the interlocking part functions also as slide means for synchronizing pay-out and winding speeds of the coating film transfer tape in the pay-out and winding reels.

13. A coating film transfer tool according to claim 12, wherein the interlocking part is provided with a frictional member employed in an outer circumference of one of the rotating pay-out part and the rotating winding part, and the frictional member is in frictional engagement with an outer circumference of the other rotating part.

14. A coating film transfer tool according to claim 11, wherein the interlocking part is provided with a frictional wheel rotatably placed in the case, and an outer circumference of the frictional wheel is in frictional engagement with the outer circumference of the rotating pay-out part and rotating winding part, respectively.

15. A coating film transfer tool according to claim 12, wherein the interlocking part is provided with an endless belt, and the endless belt is dragged through the outer circumference of the rotating pay-out part and rotating winding part, respectively, for frictional contact.

16. A coating film transfer tool according to claim 11 comprising:

a backstop mechanism for preventing inverse rotation of the pay-out and winding reels, wherein the backstop mechanism comprises a plurality of backstop claws employed in a circular form in an inner surface of a main body and a stopping claw provided in the rotating pay-out part or rotating winding part, and disengageably engaged with the backstop claw.

17. A coating film transfer tool according to claim 2, wherein the coating film transfer tape comprises a base film made of at least one of a plastic material and paper, a release agent layer formed in a side of the base film, a white corrective paint layer formed over the release agent layer, and further a pressure sensitive adhesive layer applied over the paint layer.

18. A coating film transfer tool according to claim 2, wherein the coating film transfer tape comprises a base film made of at least one of a plastic material and paper, and an adhesive layer formed n a side of the base film with a releasing agent layer inserted between them.

* * * * *